US007215603B2

(12) United States Patent
Koike

(10) Patent No.: US 7,215,603 B2
(45) Date of Patent: May 8, 2007

(54) CLOCKING APPARATUS

(75) Inventor: Nobuhiro Koike, Chino (JP)

(73) Assignee: Seiko Epson Corporation, Tokyo (JP)

( * ) Notice: Subject to any disclaimer, the term of this patent is extended or adjusted under 35 U.S.C. 154(b) by 145 days.

(21) Appl. No.: 10/853,707

(22) Filed: May 26, 2004

(65) Prior Publication Data

US 2005/0047281 A1 Mar. 3, 2005

(30) Foreign Application Priority Data

May 29, 2003 (JP) ..... 2003-152810
Apr. 26, 2004 (JP) ..... 2004-129772

(51) Int. Cl.
*G04B 19/00* (2006.01)

(52) U.S. Cl. ..... 368/223; 368/225

(58) Field of Classification Search ..... 368/62, 368/66, 69, 76, 80, 223–225, 228, 281
See application file for complete search history.

(56) References Cited

U.S. PATENT DOCUMENTS

| | | | | |
|---|---|---|---|---|
| 490,123 | A * | 1/1893 | Nicolet | 368/104 |
| 3,596,463 | A * | 8/1971 | Rudolph | 368/266 |
| 5,059,943 | A | 10/1991 | Lobello | |
| 5,235,562 | A * | 8/1993 | Vaucher | 368/28 |
| 5,339,293 | A * | 8/1994 | Kamiyama et al. | 368/21 |
| 5,894,457 | A | 4/1999 | Luth | |
| 6,466,518 | B1 * | 10/2002 | Akahane et al. | 368/64 |
| 6,621,765 | B2 * | 9/2003 | Guhl | 368/80 |
| 6,894,951 | B1 * | 5/2005 | Brandt et al. | 368/80 |

FOREIGN PATENT DOCUMENTS

| | | | |
|---|---|---|---|
| EP | 0408512 | A | 1/1991 |
| EP | 1024416 | A | 8/2000 |
| FR | 2660767 | A | 10/1991 |
| JP | 52-117198 | A | 10/1977 |
| JP | 61-132713 | U | 8/1986 |
| JP | 05-25387 | U | 4/1993 |
| JP | 09-506976 | A | 7/1997 |
| JP | 09-304552 | | 11/1997 |
| JP | 10-197653 | | 7/1998 |
| JP | 11-304966 | A | 11/1999 |

* cited by examiner

*Primary Examiner*—Vit Miska
*Assistant Examiner*—Thanh S. Phan
(74) *Attorney, Agent, or Firm*—Global IP Counselors, LLP

(57) ABSTRACT

A timing device includes a time display section and a drive unit. The time display section has a dial with a measurement indicator from a zero time position to a maximum measurable time position, and pointers capable of rotating above the dial in a fan-shaped trajectory. The drive unit drives the pointers above the dial from the zero time position to the maximum measurable time position, and stops the pointers above an extra display section in a position past the maximum measurable time after the maximum measurable time has passed.

13 Claims, 17 Drawing Sheets

A-A CROSS-SECTIONAL VIEW

B-B CROSS-SECTIONAL VIEW

C-C CROSS-SECTIONAL VIEW

D-D CROSS-SECTIONAL VIEW

CLOCKING APPARATUS

BACKGROUND OF THE INVENTION

1. Field of the Invention

The present invention relates to a timing device, and to a timing device with a chronograph, for example.

2. Background Information

In conventional practice, multifunction timepieces (timing devices) with a chronograph function are designed so that a stop operation or reset operation for the next measurement is prompted and the timing for the next measurement is prevented from being missed by informing the user in a readily recognizable format that an automatic stop has occurred when time measurement automatically stops after the maximum measurable time passes since the initiation of time measurement (for example, JP Kokai No. H11-304966).

This multifunction timepiece includes an hour hand, a minute hand, and a second hand for displaying regular time, and also includes a 1/10 second chronograph hand ("chronograph" will hereinafter sometimes be referred to as "CG;" where "CG" is an abbreviation for "chronograph"), a second chronograph hand, a minute chronograph hand, and an hour chronograph hand. The display section of these chronograph hands has circular indicators and is designed so that the maximum measurable time is measured via the chronograph hands making a full rotation from the zero position.

Since the chronograph hands automatically stop at the zero position after the maximum measurable time has passed, it is impossible to determine by looking whether they are in the automatically stopped state or whether they are in the return-to-zero condition after resetting, so the multifunction timepiece is designed so that during automatic stopping the chronograph hands are stopped at a position slightly after the zero position, and the user can determine that the chronograph is in the automatically stopped state and not in the return-to-zero condition by ascertaining that the chronograph hands have stopped in such a position.

However, when the chronograph hands are stopped at a position slightly past the zero position as with the multifunction timepiece, it is sometimes impossible to immediately determine whether this stopped state is due to automatic stopping or whether the user has used a stop operation. For example, sometimes a user who thinks he has used the stop operation may leave the timepiece unattended without knowing that measurement is actually continuing and will later check the timepiece, but the chronograph hands have stopped in the automatic stopping position.

It will be clear to those skilled in the art from the disclosure of the present invention that an improved timing device is necessary because of the above-mentioned considerations. The present invention meets the requirements of these conventional technologies as well as other requirements, which will be apparent to those skilled in the art from the disclosure hereinbelow.

SUMMARY OF THE INVENTION

An object of the present invention is to provide a timing device wherein it is possible to more reliably determine whether the pointers have stopped at the return-to-zero condition, stopped automatically, or stopped as a result of a stop operation.

The timing device of the present invention includes a time display section and a drive unit. The time display section has a dial with measurement indicators from a zero time position to a maximum measurable time position, and pointers capable of rotating above the dial in a fan-shaped trajectory. The drive unit drives the pointers above the dial from the zero time position to the maximum measurable time position, and stops the pointers after the maximum measurable time has passed.

The drive unit may also be configured to stop the pointers at a position past the maximum measurable time position above the measurement indicators after the maximum measurable time has passed.

The dial may further have an extra display section for indicating that the maximum measurable time has been exceeded. In this case, the drive unit stops the pointers above the extra display section after the maximum measurable time has passed.

The timing device may additionally be configured so that the time display section also has a second pointer, and the drive unit drives the pointer according to minute information and drives the second pointer according to second information.

The drive unit may also include a return-to-zero mechanism for mechanically returning the pointers to the zero time position.

The drive unit may further contain a motor pulse generating circuit and a motor driven by a motor pulse from the motor pulse generating circuit.

The objectives, characteristics, merits, and other attributes of the present invention described above shall be clear to those skilled in the art from the description of the invention hereinbelow. The description of the invention and the accompanying diagrams disclose the preferred embodiments of the present invention.

BRIEF DESCRIPTION OF THE DRAWINGS

Referring to the accompanying diagrams that partially disclose the present invention.

DESCRIPTION OF THE PREFERRED EMBODIMENTS

Embodiments of the invention will now be described with reference to the drawings. As will be apparent from the disclosure of the present invention to those skilled in the art, the description of the invention embodiments is intended solely to illustrate the present invention and should not be construed as limiting the scope of the present invention, which is defined by the claims described below or by equivalent claims thereof.

Figure 1:
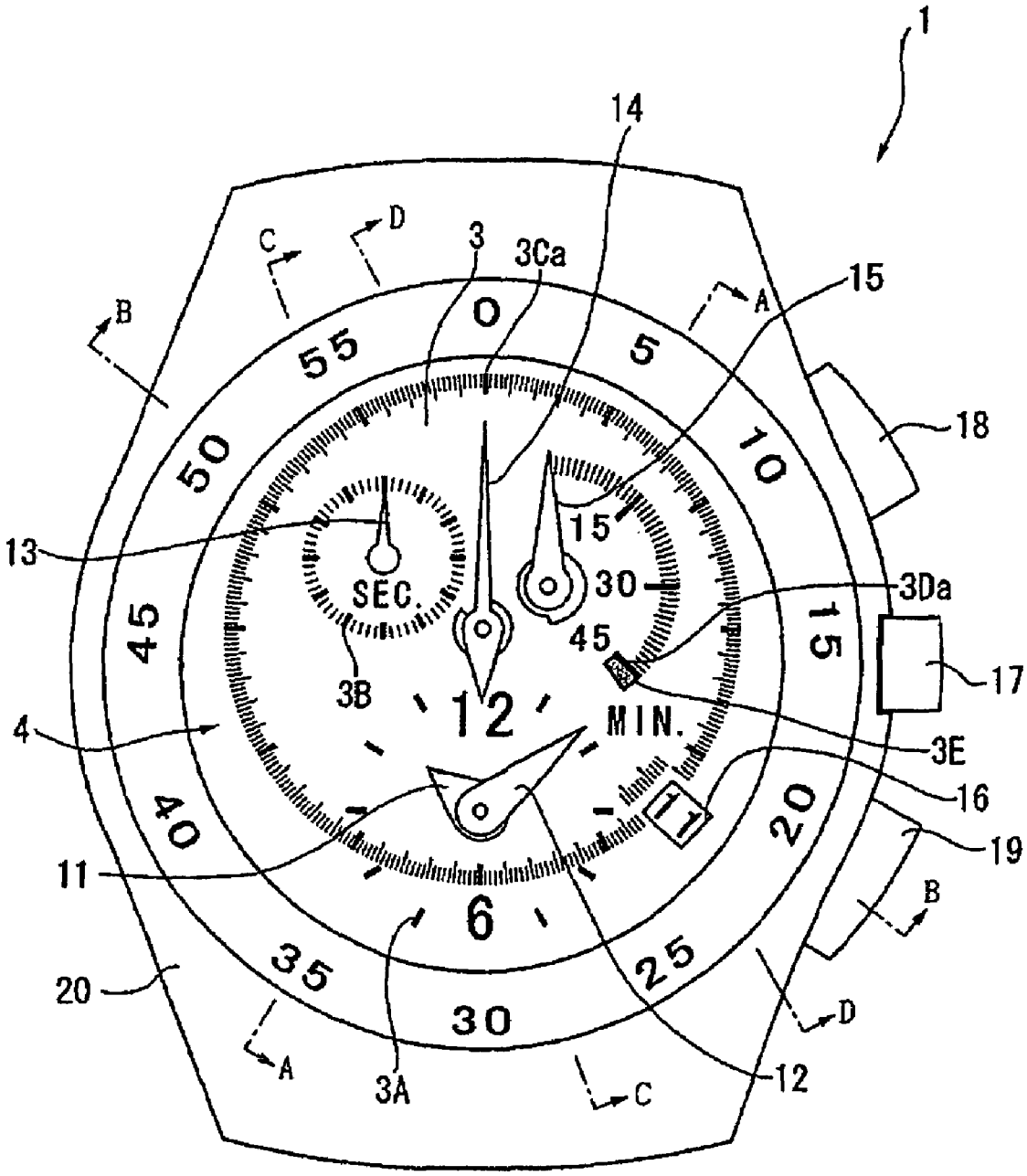
FIG. 1 is an external front view of a chronograph timepiece, which is the first embodiment of the present invention.

FIG. 1 shows an external front view of a chronograph timepiece 1, which is an embodiment of the multifunction timepiece of the present invention.

Figure 2:
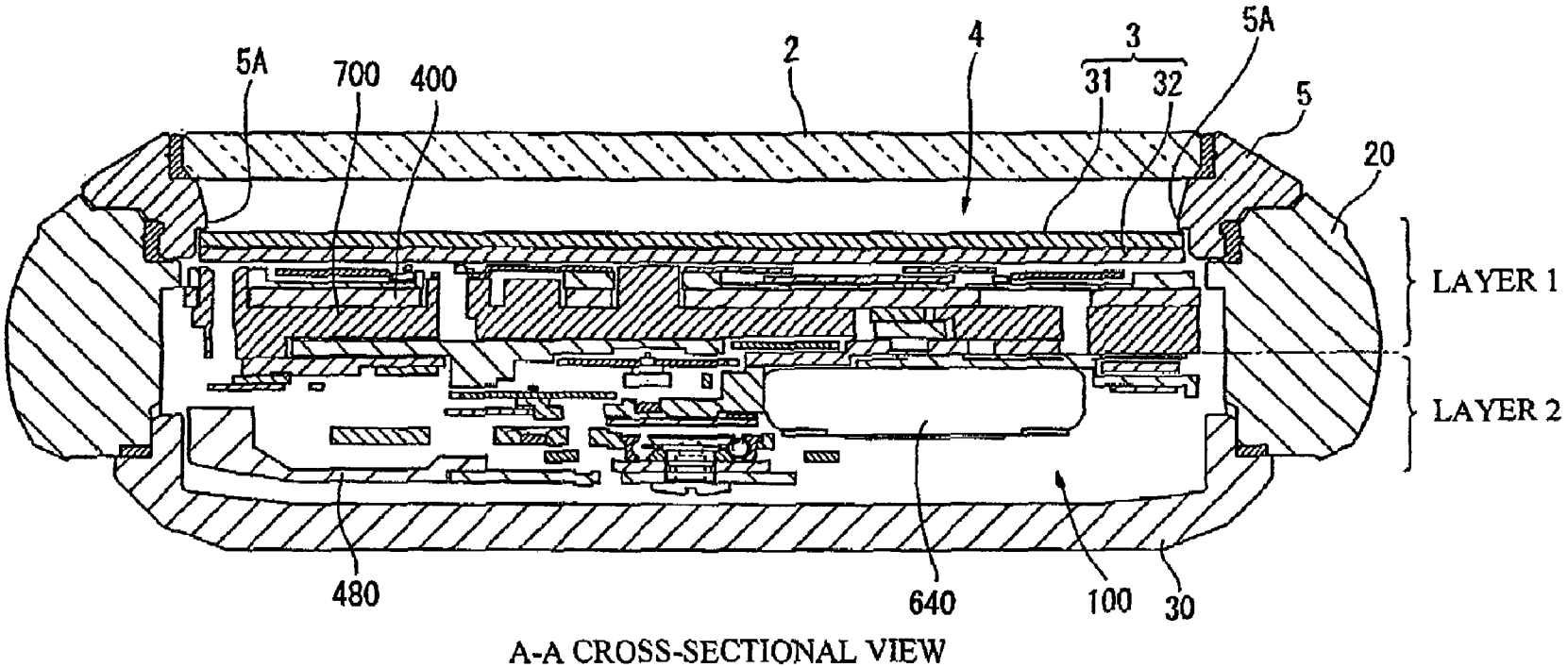
FIG. 2 is a cross-sectional view along the line A—A in FIG. 1.
Figure 3:
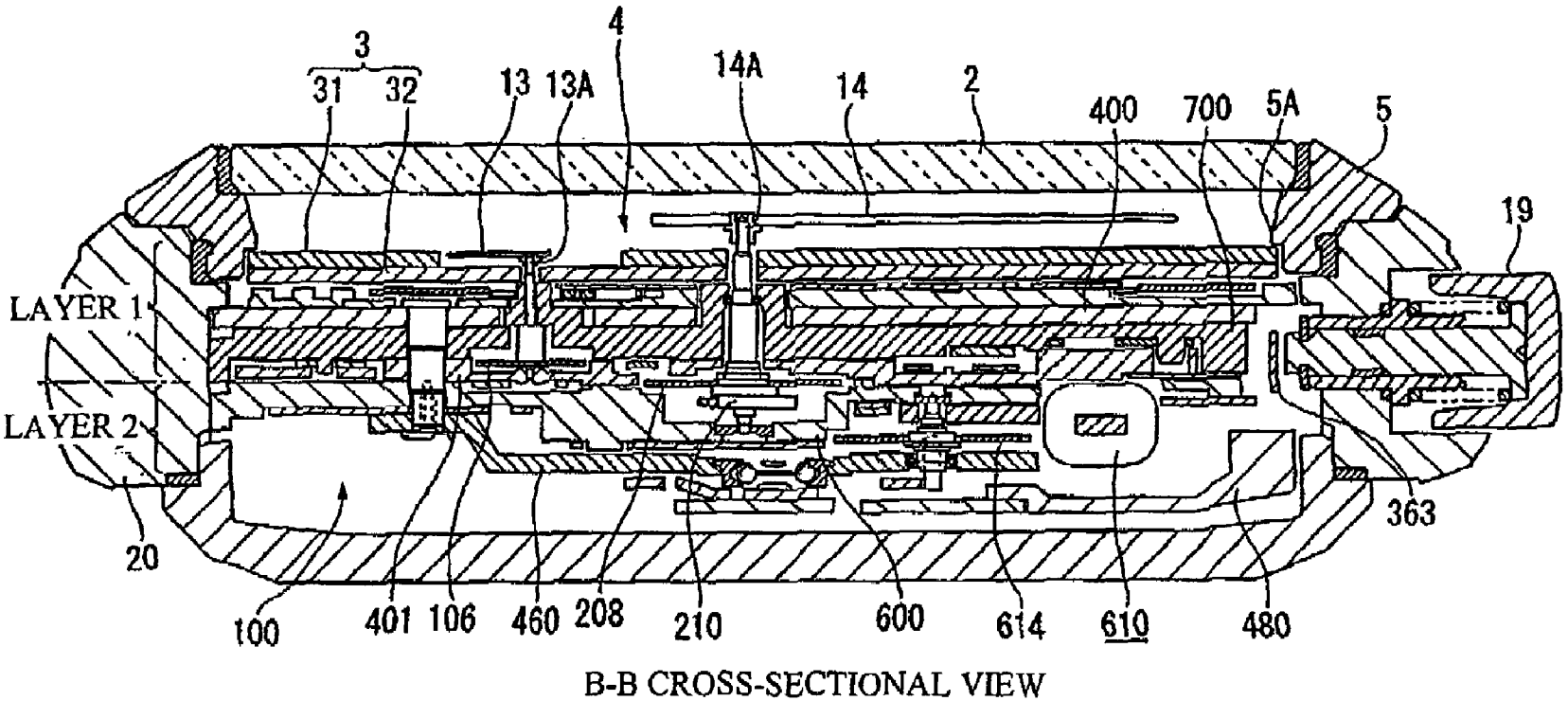
FIG. 3 is a cross-sectional view along the line B—B in FIG. 1.
Figure 4:
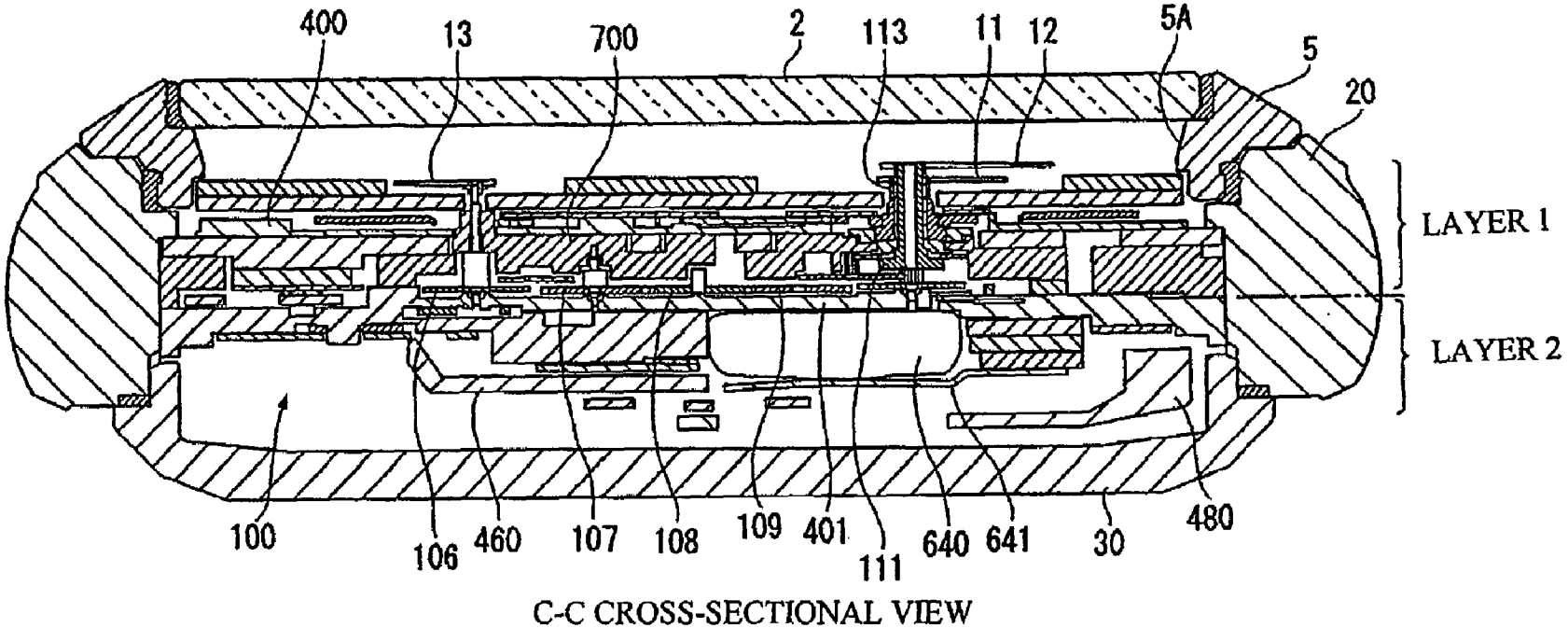
FIG. 4 is a cross-sectional view along the line C—C in FIG. 1.
Figure 5:
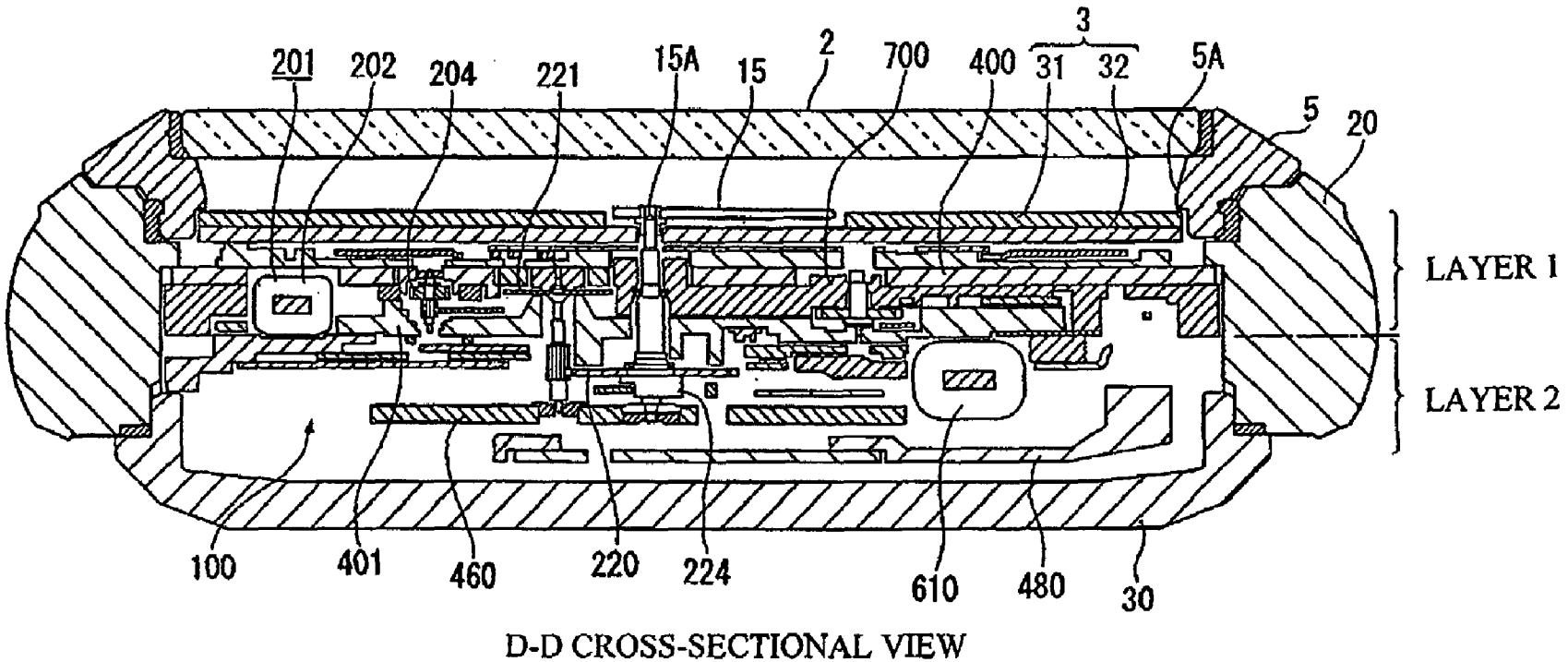
FIG. 5 is a cross-sectional view along the line D—D in FIG. 1.

This chronograph timepiece 1 includes a time display section 4 consisting of a dial 3 visible through transparent glass 2, as shown in FIGS. 2 through 4, which are cross-sectional views along the cross-sectional lines A—A through D—D in FIG. 1. Specifically, the time display section 4 is partitioned off around the inside of the inner peripheral surface (parting surface) 5A of a glass-holding ring 5 mounted around the dial 3. Therefore, in the present embodiment, the time display section 4 is partitioned off into a roughly circular shape when viewed from the front, and the parting section for partitioning off the time display section 4 is formed by the glass-holding ring 5.

[1. Pointer Layout Configuration]

The chronograph timepiece 1 has an hour hand 11, a minute hand 12, and a second hand 13 designed for displaying the standard time and mounted on the time display section (time display device) 4, and a second chronograph hand (second CG hand) 14 and a minute chronograph hand (second pointer) 15 for displaying information other than the standard time, namely, the chronograph time, as shown in FIG. 1.

Also, a crown 17, which is an external operating member for correcting the standard time, is mounted on the side of the timepiece 1 in the 3:00 direction; a start and stop button 18 for starting and stopping the second CG hand 14 and minute CG hand 15 is mounted in the 2:00 direction; and a reset button 19 for returning the second CG hand 14 and minute CG hand 15 to zero is mounted in the 4:00 direction.

Figure 6:
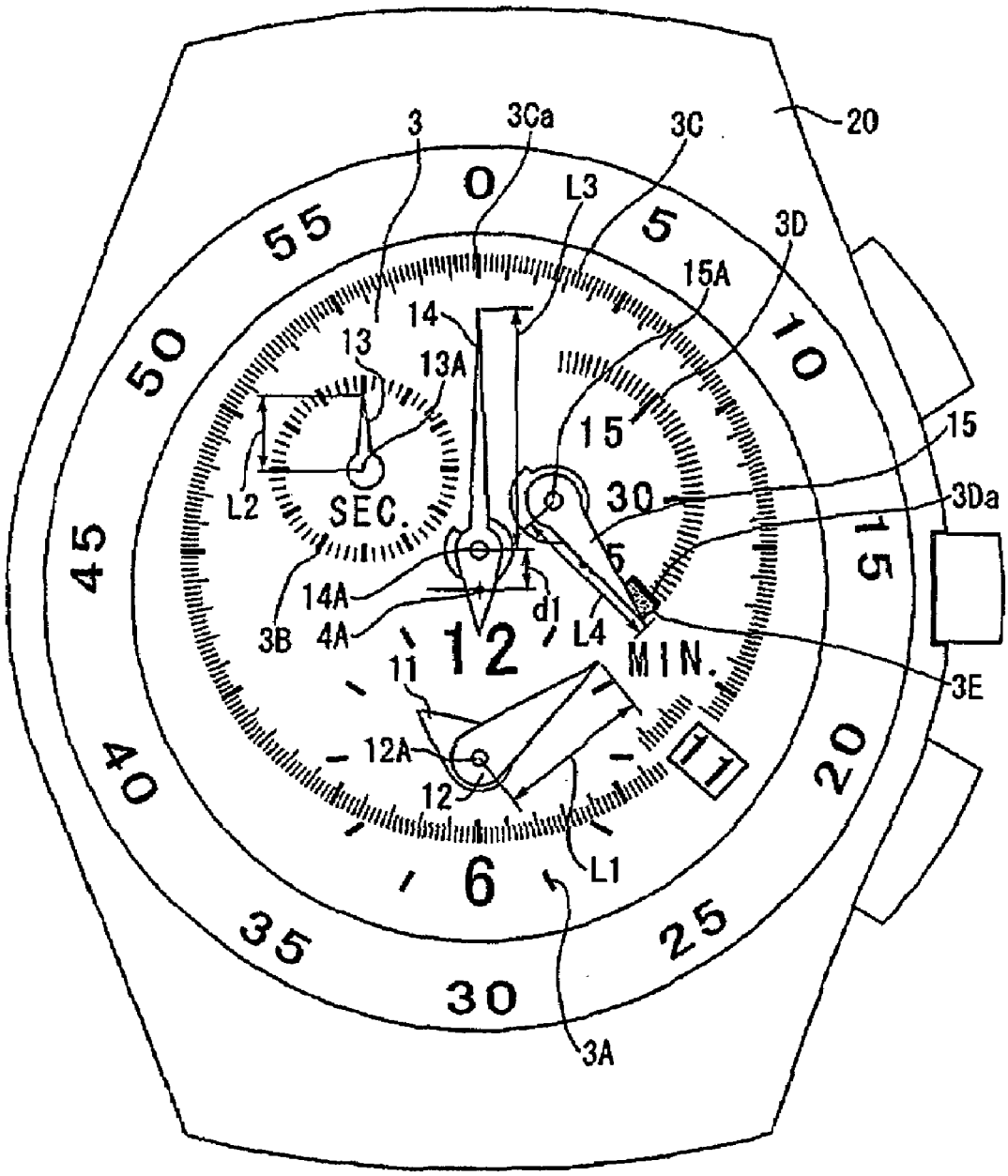
FIG. 6 is an enlarged external front view of the chronograph timepiece.

The shafts 12A of the hour hand 11 and minute hand 12 are coaxial, and this shaft 12A is provided to a position (the lower middle of FIG. 6) that is offset from the center 4A of the time display section 4 in the 6:00 direction, as shown in FIG. 6. The second hand 13 is mounted at a position wherein the shaft 13A thereof is offset from the center 4A roughly in the 10:00 direction.

The second CG hand 14 for displaying the second chronograph time is mounted at a position wherein the shaft 14A thereof is slightly misaligned (eccentric) from the center 4A in the 12:00 direction. The eccentricity d1 is about 1.5 mm in the present embodiment, but this eccentricity d1 may be set according to the size, design, and the like of the timepiece 1, and is not limited to 1.5 mm alone.

Also, the minute CG hand 15 for displaying the minute chronograph time is mounted at a position wherein the shaft 15A thereof is offset from the center 4A roughly in the 2:00 direction.

The pointers 11 through 14 are rotated around the timepiece similar to a regular timepiece, but only the minute CG hand 15 moves in a fan pattern above the fan-shaped indicator. In other words, the minute CG hand 15 rotates around the timepiece from the return-to-zero condition (reset state) shown in FIG. 6. The measurement indicators have graduations from the zero time position to the maximum measurable time position.

Also, when the reset button 19 is pressed, the minute CG hand 15 is designed to rotate in the opposite direction and to return to the initial position (reset state). In the present embodiment, the minute chronograph is a 45-minute timer, and can be used to keep time for soccer, rugby, and other such games.

If the lengths from the shafts 12A through 15A of the minute hand 12, the second hand 13, the second CG hand 14, and the minute CG hand 15 to the tips of the pointers 12 through 15 are respectively denoted by L1 through L4, then the length L3 of the second CG hand 14 is made greater than the lengths L1, L2, and L4 of the other pointers. Specifically, in the present embodiment, the length A from the shaft 14A of the second CG hand 14 pointer to the tip of the second CG hand 14 is L3, the length B from the shaft 12A of the minute hand 12 to the tip of the minute hand 12 is L1, the length C from the shaft 13A of the second hand 13 to the tip of the second hand 13 is L2, and the length D from the shaft 15A of the second pointer, the minute CG hand 15, to the tip of the minute CG hand 15 is L4.

The interval (distance) between the shaft 12A of the minute hand 12 and the shaft 14A of the second CG hand 14 is greater than the length L1 of the minute hand 12, and is designed so that the minute hand 12 does not run into the shaft 14A. It is apparent that the hour hand 11 is shorter than the minute hand 12 and is disposed coaxially with the minute hand 12 to prevent the hour hand 11 from running into the shaft 14A.

In addition to the above-mentioned conditions, the length L1 of the minute hand 12 and the position of the shaft 12A are designed so that the tip of the minute hand 12 does not come into contact with the glass-holding ring 5, which is the parting section, when the minute hand 12 rotates around the shaft 12A. Specifically, the shaft 12A is disposed at a position substantially halfway between the inner surface 5A of the glass-holding ring 5 in the 6:00 direction and the shaft 14A, and the length L1 of the minute hand 12 is set according to the position thereof.

The interval (distance) between the shaft 13A of the second hand 13 and the shaft 14A is also greater than the length L2 of the second hand 13, and is designed so that the second hand 13 does not run into the shaft 14A.

The second hand 13 is mounted in the time display section 4 roughly in the 10:00 direction, and since the space in which it can be mounted is smaller than the space in the 6:00 direction in which the hour and minute hands 11 and 12 are mounted, the length L2 of the second hand 13 is less than the length L1 of the minute hand 12. The length L2 of the second hand 13 and the position in which the shaft 13A is located are set so as to prevent the second hand from running into the shaft 14A and the glass-holding ring 5 on the outer periphery of the time display section 4, similar to the minute hand 12.

On the other hand, the interval between the shaft 15A of the minute CG hand 15 and the shaft 14A is smaller than the length L4 of the minute CG hand 15, and the shafts 14A and 15A are disposed adjacent to each other.

Therefore, the minute CG hand 15 may collide with the shaft 14A when the hand 15 makes a full circle. In the present embodiment, therefore, the configuration is so that the minute CG hand 15 does not make a full circle as do the other pointers 11 through 14 as previously described, and is capable of being turned and driven only within a specific angle range, or, in other words, the drive trajectory thereof is fan shaped.

Here, the shafts 12A, 13A, and 15A of the hour hand 11, minute hand 12, second hand 13, and minute CG hand 15 are disposed within the movement trajectory of the second CG hand 14. Therefore, the vertical position (level) of the second CG hand 14 is disposed higher (next to the glass 2) than the vertical position of the hands 11 through 13 and 15, and the vertical level is set so that the second CG hand 14 does not interfere with the hands 11 through 13 and 15.

The dial 3 on which the indicators 3A through 3D are formed is also disposed in alignment with the vertical positions of the hands 11 through 15 because the vertical positions of the hands 11 through 13 and 15 differ from that of the second CG hand 14.

Specifically, the dial 3 is configured from two vertically overlapping dials 31 and 32, as shown in FIGS. 2 through 4. The indicator 3C for the second CG hand 14 is formed on the upper dial 31 (next to the glass 2). In the dial 31, holes are machined at the points where the hands 11 through 13 and 15 are mounted so that the lower dial 32 is exposed. Therefore, the indicators 3A, 3B, and 3D are formed on the dial 32.

Also, a through-window 16 for exposing the date wheel and displaying the date is formed in the dials 31 and 32 in the section roughly halfway between the 4:00 and 5:00 direction of the dial 3 (roughly the 4:30 direction).

Indicators for indicating the standard time and indicators for indicating the chronograph time are formed on the dial 3 in correspondence with the pointers 11 through 15. Specifically, the indicator 3A for indicating the hours and minutes of standard time is formed in a circle at a position in the 6:00 direction. The indicator 3B for indicating the second of standard time is also formed in a circle at a position substantially in the 10:00 direction. The indicator 3C for indicating the second chronograph time is formed in a circle slightly smaller than the outer periphery of the dial 7, with the center thereof slightly offset (eccentric) from the 12:00 side.

The indicator 3D for indicating the minute chronograph time is painted in black, for example, along an arcuate portion in a fan pattern. The indicator 3D is formed in units for indicating the minutes, and contains the largest units among those that indicate chronograph time in the present embodiment. Also, the angle of the center section of the fan pattern is 135 degrees in the present embodiment, and therefore in the present embodiment, which relates to a 45-minute timer, the reduction rate from second to minutes is set at 1/120, and the indicator 3D is formed in 3-degree increments.

In the indicator 3D, an indicator 3Da is formed at a location indicating the maximum measurable time, and an extra display section 3E extending along the arcuate portion is provided in red, for example, to the outer side of the indicator 3Da. The length of the extra display section 3E along the arcuate portion corresponds to a length of three minutes in the present embodiment, which is equivalent to a length spanning about 9 degrees in the arc of the fan pattern, and having a considerable indicator width of three minutes allows for a width sufficiently larger than the thickness of the minute CG hand 15 and improves visibility so that the extra display section 3E is not obscured by the minute CG hand 15. Also, the indicator width of the extra display section 3E is greater than the degree of wobbling of the minute CG hand 15 in the direction of rotation resulting from backlash, shaft chatter, or other defects in the chronograph train wheel, to be hereinafter described.

In the chronograph timepiece 1, when the maximum measurable time of 45 minutes passes after initiating chronograph time measurement, the second CG hand 14 automatically stops above the indicator 3Ca in the 0 second position of the circular indicator 3C, but the minute CG hand 15 automatically stops at a position beyond the indicator 3Da for indicating the maximum measurable time, or, specifically, past the end of the extra display section 3E (tip in the direction of rotation) as shown in FIG. 6, and not above the indicator 3Da.

However, the second CG hand 14 and the minute CG hand 15 have the same stop timing, and while the minute CG hand 15 passes the indicator 3Da and moves a distance of three minutes, for example, the second CG hand 14 also moves a distance of three minutes and the hands 14 and 15 then stop simultaneously. Also, the arbitrarily set length and other properties of the extra display section 3E should be taken into consideration when determining at what position above the extra display section 3E the minute CG hand 15 will stop, and the center position or other position of the extra display section 3E may be selected. Furthermore, the indicator width of the extra display section 3E is not limited to a distance of three minutes and can be arbitrarily set with consideration to the thickness of the minute CG hand 15 and the entire design above the dial 7.

The chronograph timepiece 1 includes a case 20, a glass-holding ring 5 fitted via packing in the top opening of the case 20, glass 2 held by the glass-holding ring 5, and a back cover 30 fitted via packing in the bottom opening of the case 20, as shown in FIGS. 2 through 4. In the present embodiment, the vertical positional relationship of the timepiece 1 in the cross-sectional direction is so that the glass 2 is on the top, and the back cover 30 is on the bottom, unless particularly specified.

A movement 100 for driving the hands 11 through 15 is mounted in the internal space surrounded by the case 20, the glass 2, and the back cover 30.

[2. Movement Structure]

Next, the configuration of the movement 100 of the chronograph timepiece 1 will be described. In broad terms, the movement 100 of the present embodiment has a two-layer structure. A basic timepiece train wheel for displaying the standard time, a CG (chronograph) train wheel for displaying the chronograph time, and a time correction mechanism for correcting the standard time are mounted in the first layer.

Also, a coil block for power generation, a stator, a power-generating train wheel, a secondary battery for charging electric energy, and a chronograph resetting mechanism (resetting device) are mounted in the second layer.

A printed circuit board 501 for electrically controlling the standard time display and chronograph display and for controlling the power generator is mounted between the first layer and the second layer.

In the present embodiment, the first layer is the upper side of the timepiece 1, or, in other words, the side near the glass 2, and the second layer is the lower side of the timepiece 1, or, in other words, the side near the back cover 30.

[2-1. Configuration of First Layer of Movement]

Figure 7:
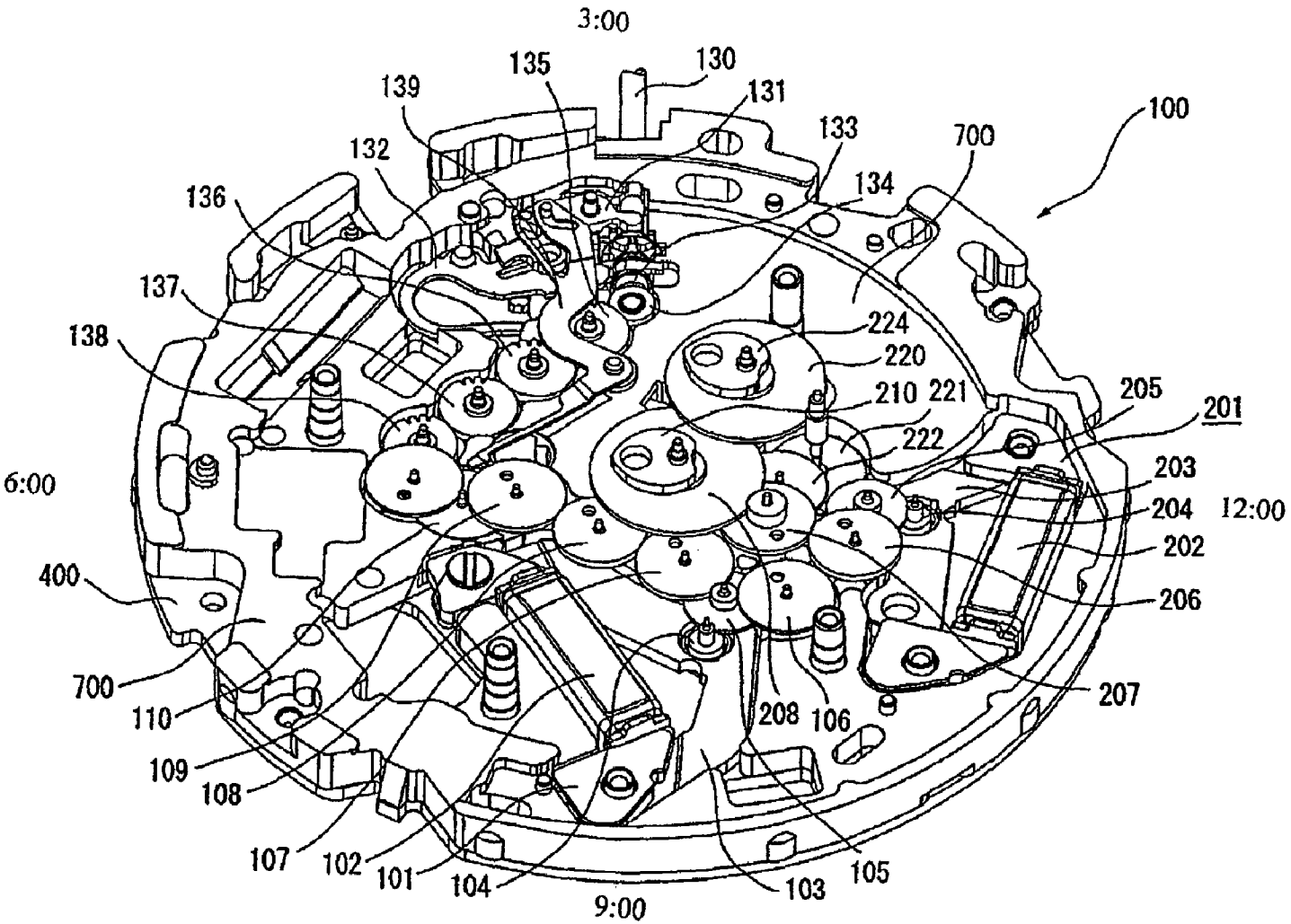
FIG. 7 is a perspective view showing a state during the step of assembling the movement.
Figure 8:
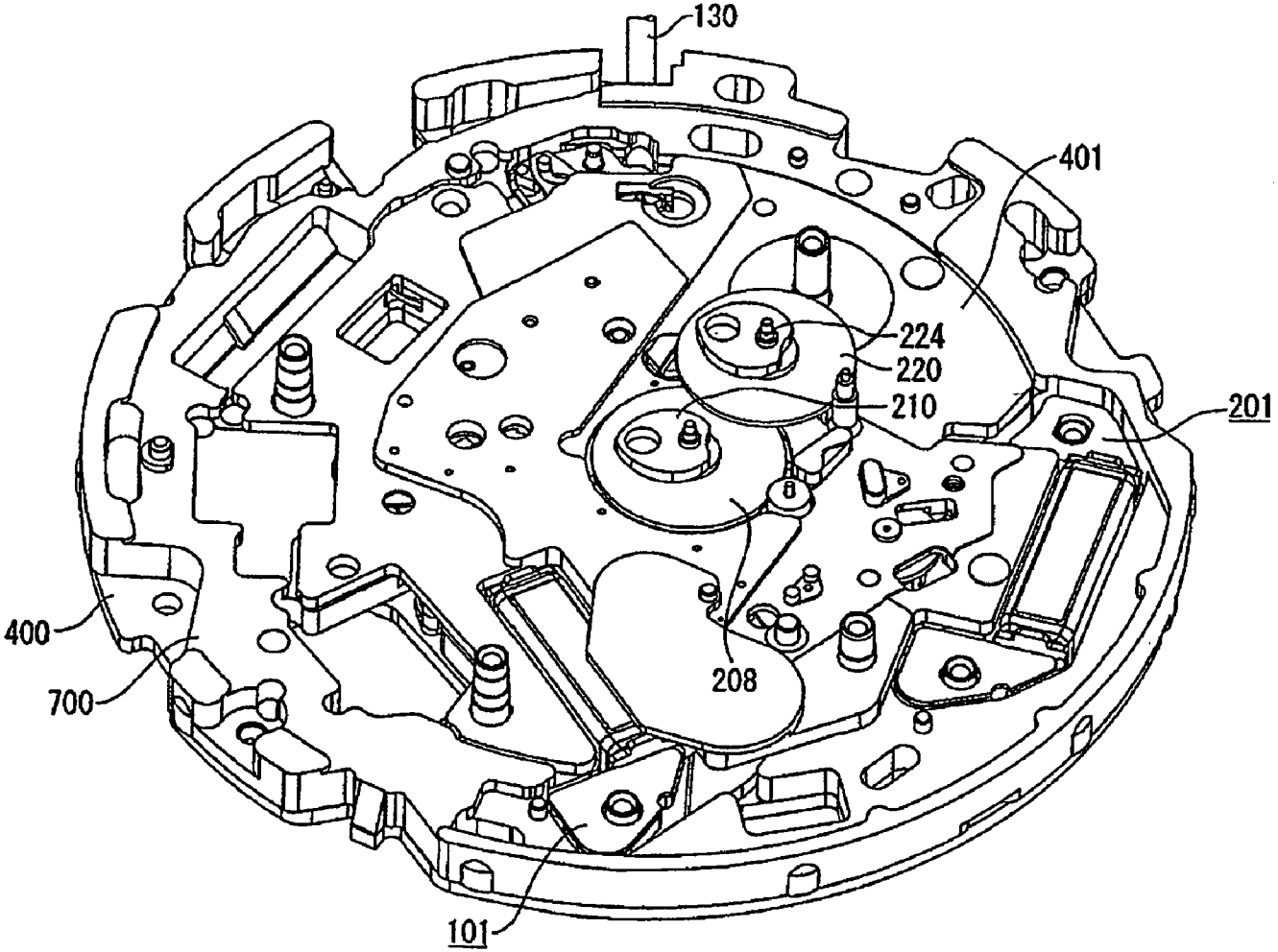
FIG. 8 is a perspective view showing a state during the step of assembling the movement.

A basic timepiece train wheel or chronograph train wheel, and a time correction mechanism are mounted in the first layer of the movement 100, as shown also in FIG. 7. The perspective view in FIG. 7 shows the back cover 30 as the top and the glass 2 as the bottom. This is because normally the components are assembled on a main plate 400 when the movement 100 is being assembled. This vertical positional relationship is also the same in the perspective views in FIGS. 8 through 14, which show the process of assembling the movement 100.

A synthetic resin circuit cover 700 is mounted on the top surface (next to the back cover) of the main plate 400, and toothed wheels or the like for each train wheel are mounted on this circuit cover 700 as shown in FIG. 7.

[2-1-1. Basic Timepiece Train Wheel]

A rough structure of the basic timepiece train wheel for showing the standard time will now be described. The basic timepiece is configured with a basic timepiece electric motor 101 and a basic timepiece train wheel.

The basic timepiece electric motor 101, which is a drive source for the basic timepiece, is configured from a basic timepiece coil 102, a basic timepiece stator 103, and a basic timepiece rotor 104. The basic timepiece rotor 104 is rotated at a timing of one step per second by a drive signal from the electric circuit, and the drive is reduced and transmitted to a small second wheel and pinion 106 via a fifth wheel and pinion 105. Therefore, the second of the standard time are displayed by means of a basic timepiece second hand (small second hand) 13 supported on the small center wheel and pinion 106.

Specifically, the basic timepiece electric motor 101 is mounted near the small center wheel and pinion 106 for supporting the small second hand 13. Display irregularities during movement of the small second hand 13 can thereby be suppressed.

Also, the rotation of the rotor 104 is reduced and transmitted to a center wheel and pinion 111 via the fifth wheel and pinion 105, a fourth third intermediate wheel 107, a fourth second intermediate wheel 108, a fourth first intermediate wheel 109, and a third wheel and pinion 110. Therefore, the minutes of the standard time are displayed by the minute hand 12 of the basic timepiece supported on the center wheel and pinion 111. The drive is transmitted from the center wheel and pinion 111 to an hour-wheel 113 via the date rear wheel to display the hour of the standard time.

Here, the distance becomes extremely large between the second hand 13 disposed away from the center 4A of the time display section 4 roughly in the 10:00 direction, and the hour hand 11 and minute hand 12 disposed in the 6:00 direction. Therefore, in the present embodiment, three intermediate wheels 107 through 109 that do not increase or reduce speed are disposed to transmit the rotation of the basic timepiece electric motor 101 to the center wheel and pinion 111, which is located at a distance from the rotor 104. The intermediate wheels 107 through 109 are toothed wheels that do not increase or reduce speed, and are therefore configured from similar toothed wheels. Thus, the cost does not greatly increase even if the number of toothed wheels increases.

The basic timepiece train wheel is thus configured from the toothed wheels 105 through 111.

[2-1-2. Time Correction Mechanism]

The time correction mechanism for correcting the time of the hour hand 11 and minute hand 12 has a setting stem 130 on which a crown 17 is fixed, and a switching section configured from a setting lever 131, a bolt 132, a train wheel setting lever 139, a clutch wheel 133, and the like for setting the setting stem 130 to the following set positions: a normal state position, a time correction position, and a calendar correction position. The setting stem 130 is disposed in the 3:00 direction of the timepiece 1, and the switching section is disposed from the 3:00 direction to the 5:00 direction.

Since the setting stem 130 disposed in the 3:00 direction and the hour hand 11 and minute hand 12 disposed in the 6:00 direction are separated, the time correction mechanism of the present embodiment has three intermediate wheels 135 through 137.

Specifically, the setting lever 131 is coupled with the bolt 132, and the clutch wheel 133 interlocks with a setting-wheel 134 by pulling out the setting stem 130 fixed to the crown 17. The setting-wheel 134 transmits the rotation of the setting stem 130 to a minute wheel 138 sequentially via the third intermediate minute wheel 135, the date rear second intermediate wheel 136, and the date rear first intermediate wheel 137, whereby the standard time is corrected. The train wheel setting lever 139 locks onto the setting lever 131, and the fourth first intermediate wheel 109 is set in conjunction with the pulling out of the setting stem 130.

The intermediate wheels 134 through 137, which are provided herein because of the separation of the crown 17 and the hour and minute hands 11 and 12, are toothed wheels that do not increase or reduce speed, and therefore are configured from toothed wheels similar to the minute wheel 138. Thus, the cost does not greatly increase even if the number of toothed wheels increases.

[2-1-3. Chronograph Train Wheel]

The chronograph timepiece is configured with a chronograph electric motor 201 and a chronograph train wheel.

The chronograph electric motor 201, which is a drive source for the chronograph train wheel, is configured from a coil 202, a stator 203, and a rotor 204, and is disposed roughly in the 12:00 direction of the timepiece 1. In the chronograph electric motor 201, the rotor 204 is rotatably driven by a drive signal from the electric circuit.

The rotation of the rotor 204 is transmitted to a second CG wheel 208 via a second CG third intermediate wheel 205, a second CG second intermediate wheel 206, and a second CG first intermediate wheel 207, and the chronograph second are displayed by the second CG hand 14 supported by the second CG wheel 208.

The rotation transmitted to the second CG first intermediate wheel 207 is transmitted from the second CG first intermediate wheel 207 to a minute CG wheel 220 via a minute CG second intermediate wheel 222 and a minute CG first intermediate wheel 221, and the chronograph minutes are displayed by the minute CG hand 15 supported by the minute CG wheel 220. Specifically, the second CG first intermediate wheel 207 has two pinions at the top and bottom, and the second CG wheel 208 interlocks with one pinion, while the second intermediate wheel 222 interlocks with the other pinion.

The second CG wheel 208 and minute CG wheel 220 both have heart-cams 210 and 224 for resetting to zero. Among the rods and toothed wheels constituting the second CG wheel 208 and minute CG wheel 220, the same rods are used for the gears 208 and 220, while only the toothed wheels differ. The second CG wheel 208 and the minute CG wheel 220 are disposed in a cross-sectional misalignment because the pointer lengths differ as shown in FIG. 7.

A train wheel bridge 401 is mounted on the top of the basic timepiece train wheel and the chronograph train wheel mounted in the first layer of the movement 100 described above (next to the back cover), as shown in FIG. 8, and upper tenons (those next to the back cover) of the basic timepiece train wheel and the chronograph train wheel are supported in a rotatable manner by the train wheel bridge 401. Specifically, the basic timepiece train wheel and the chronograph train wheel are supported between the circuit cover 700 and the train wheel bridge 401 installed on the top surface of the main plate 400.

[2-2. Configuration of Middle Layer of Movement]

Figure 9:
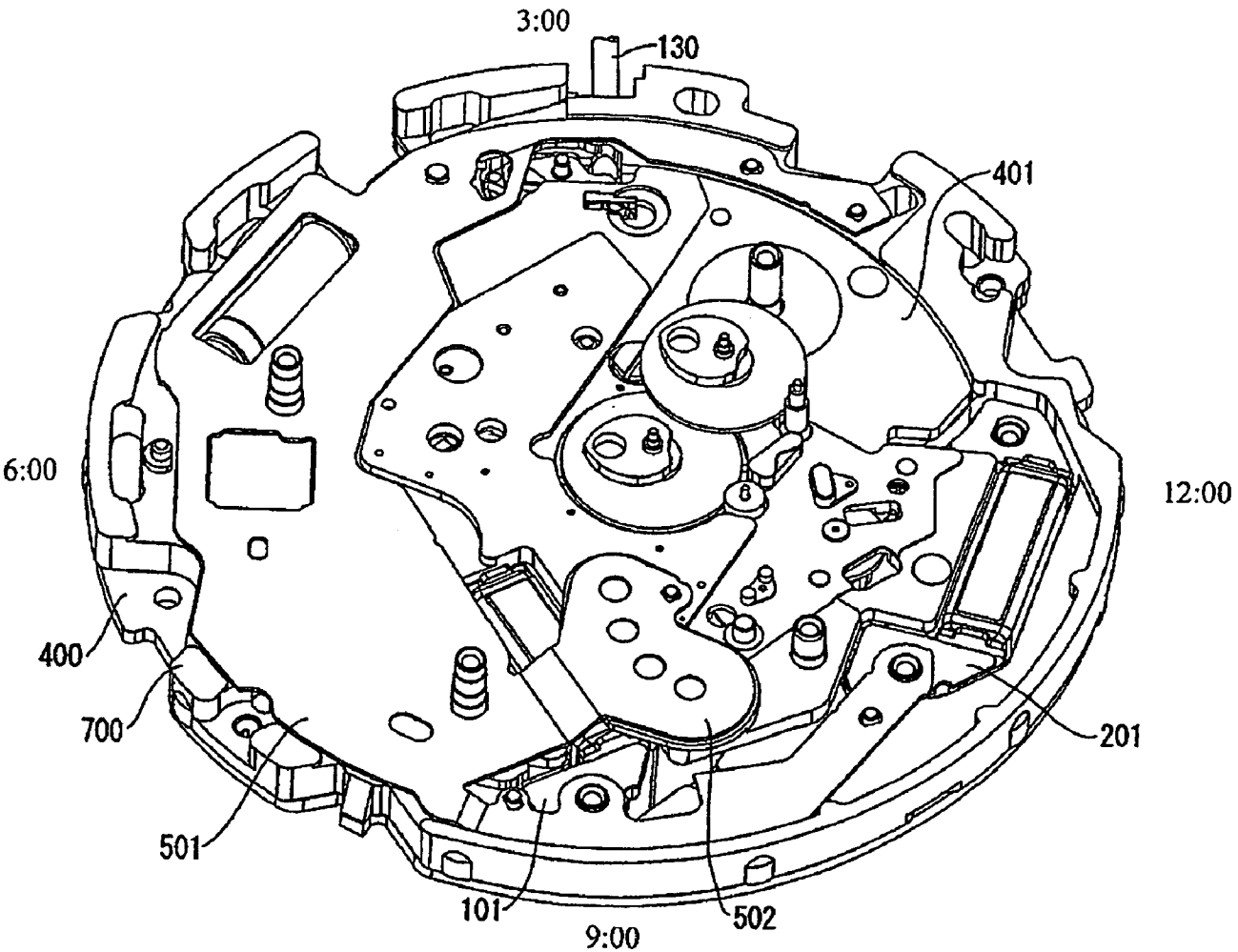
FIG. 9 is a perspective view showing a state during the step of assembling the movement.

A printed circuit board 501 is mounted on the train wheel bridge 401 (next to the back cover), as shown in FIG. 9. The printed circuit board 501 is formed into a flat rough C-shape along the inner periphery of the case of the timepiece I. The board extends from the section in which the start and stop button 18 is disposed roughly in the 2:00 direction of the timepiece 1, to the reset button 19, the 6:00 position, and the 10:00 position at which the electric motors are disposed.

The driving of the electric motors 101 and 201 can be controlled, and the operating state of the buttons 18 and 19 detected, by an IC or another such electric circuit provided to the printed circuit board 501.

Furthermore, the printed circuit board 501 is provided with a conduction terminal section 502 having four conduction terminals for providing conduction with the circuits in the second layer.

[2-3. Configuration of Second Layer of Movement]

A coil block for power generation, a stator, a power-generating train wheel, a secondary battery for charging electric energy, and a chronograph resetting mechanism are mounted in the second layer of the movement 100.

Figure 10:
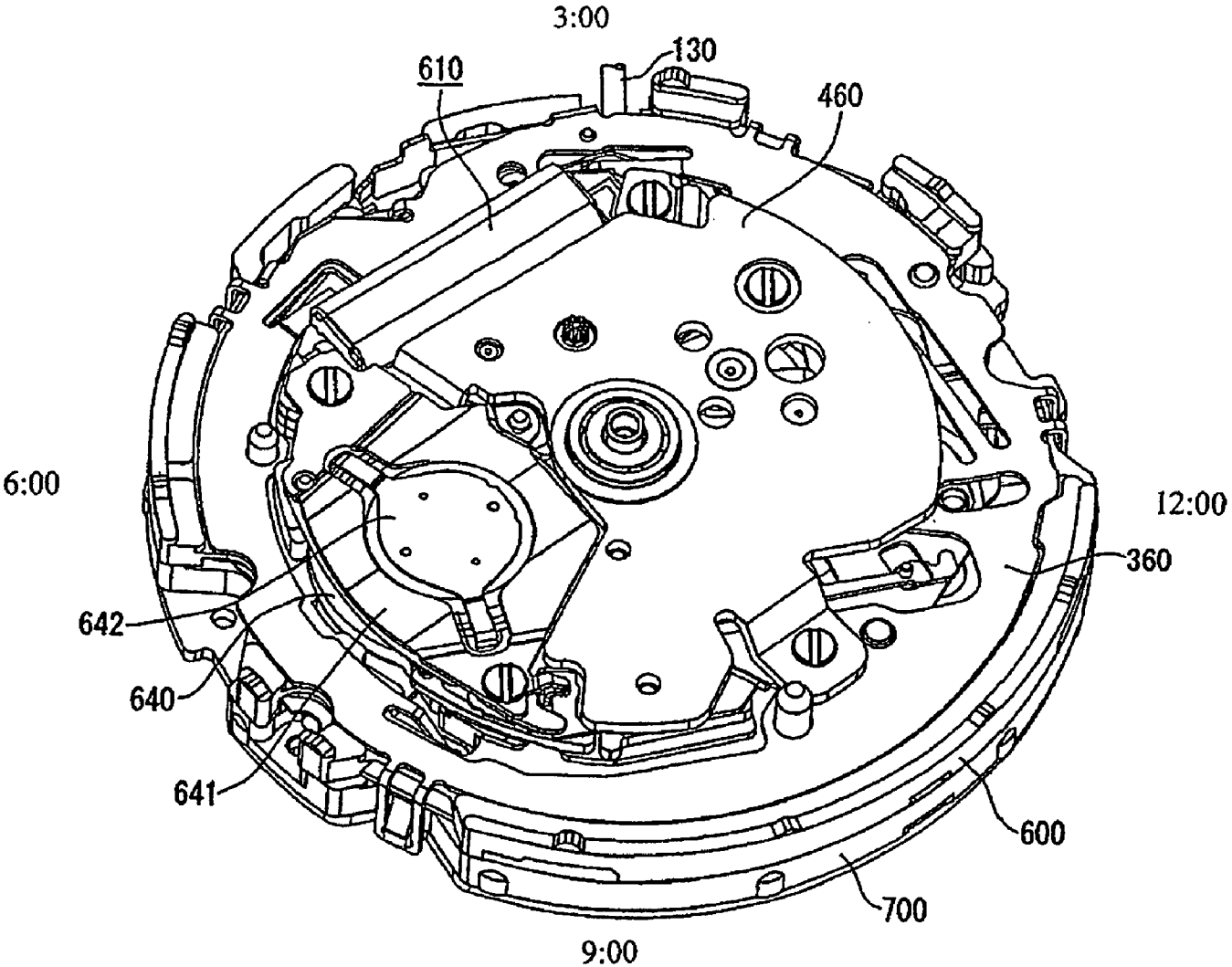
FIG. 10 is a perspective view showing a state during the step of assembling the movement.

The second layer of the movement has a circuit cover 600 disposed in overlapping fashion on the printed circuit board 501 (next to the back cover), as shown in FIG. 10. The circuit cover 600 constitutes a base for the power generator, the secondary battery, and the resetting mechanism.

Figure 11:
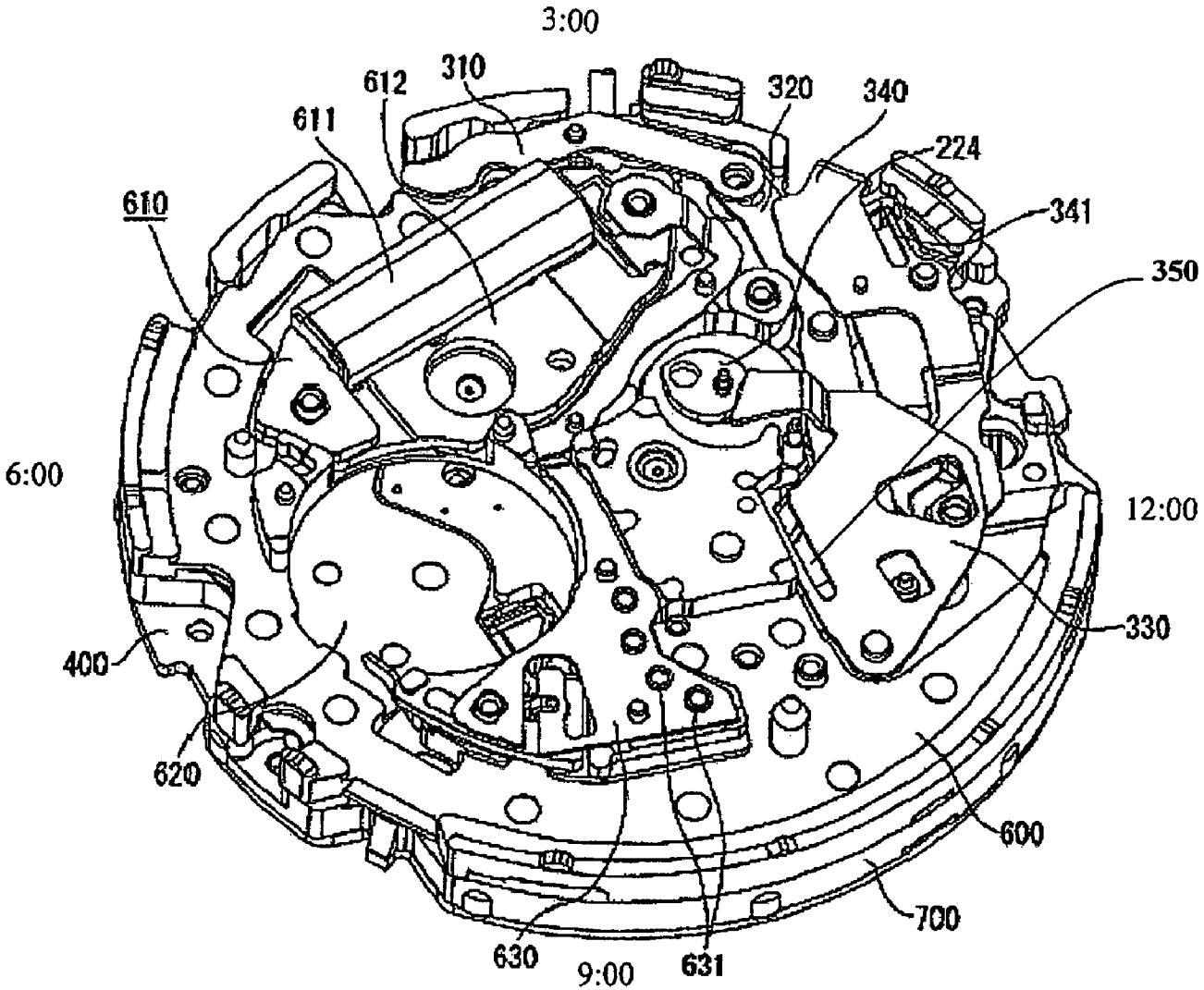
FIG. 11 is a perspective view showing a state during the step of assembling the movement.
Figure 12:
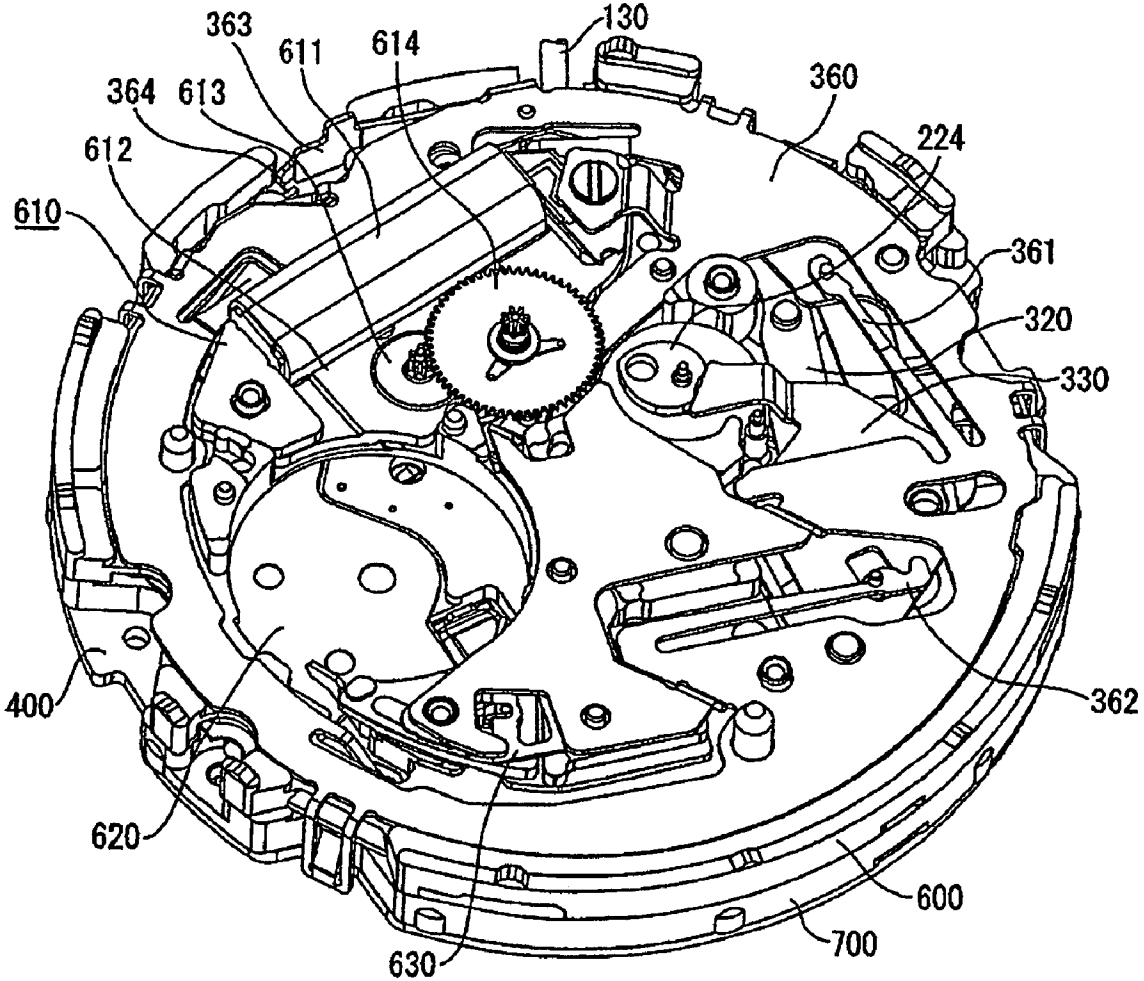
FIG. 12 is a perspective view showing a state during the step of assembling the movement.

Specifically, a power generator 610 with a power-generating coil block 611, a power-generating stator 612, and a power-generating rotor 613 is disposed roughly in the 4:00 direction of the circuit cover 600, as shown in FIGS. 11 and 12.

A virtually cylindrical bed 620 for mounting a secondary power source 640 is formed roughly in the 8:00 direction, and a conduction board 630 is disposed along the outer periphery thereof. Disposing four conduction coils 631 in four through-holes formed in the circuit cover 600 allows the ends thereof to be in contact with the terminals of the printed circuit board 501 and the conduction board 630. The printed circuit board 501, which is electrically connected to the electric motors 101 and 201 and other components of the first layer of the movement 100, is thereby configured to electrical connections to be made via the conduction coils 631, as is the conduction board 630 electrically connected to the power generator 610 or the secondary power source 640 of the second layer.

The circuit cover 600 supports the upper tenons on the shafts of the second CG wheel 208 and second CG first intermediate wheel 207 in a rotatable manner.

Furthermore, heart-cams 210 and 224, a hammer 330 in contact with the heart-cams 210 and 224, an operating lever 340 that rotates as the start and stop button 18 is pressed to separate the hammer 330 from the heart-cams 210 and 224, a transmission lever 310 and transmission hammer 320 that rotate when the reset button 19 is pressed to bring the hammer 330 into contact with the heart-cams 210 and 224, and other such levers constituting the resetting mechanism are mounted extending roughly from the 4:00 position to the 10:00 position of the timepiece 1 so as to overlap in the vertical direction of the CG train wheel or CG electric motor 201.

The lever components constituting the resetting mechanism are also mounted so as to: not overlap in the same plane as the power generator 610 or secondary power source 640.

A switch input terminal 341 is formed integrally with the operating lever 340, and the switch input terminal 341 comes into contact with the terminals of the printed circuit board 501 when the start and stop button 18 is pressed, making it possible to detect the pressing of the button 18, or, in other words, the input of the switch.

A return-to-zero holder 360 is mounted on the levers 310, 320, 330, and 340 of the return-to-zero mechanism (next to the back cover), as shown in FIG. 12, and the levers 310, 320, 330, and 340 are supported between the return-to-zero holder 360 and the circuit cover 600. A click spring 361 interlocking with a pin protruding from the operating lever 340, and a click spring 362 interlocking with a pin protruding from the transmission hammer 320, are formed integrally in the return-to-zero holder 360.

Also, a spring 363 with which the reset button 19 is in contact is formed on the return-to-zero holder 360, as shown in FIG. 12. Therefore, the transmission lever 310 is pressed via the spring 363 and is rotated when the reset button 19 is pressed. The spring 363 elastically holds an input terminal section 364 formed on the side facing the return-to-zero holder, and when the reset button

19 is pressed, the spring 363 releases the input terminal section 364 formed on the return-to-zero holder 360, and the input terminal section 364 comes into contact with a reset terminal provided to the printed circuit board 501. Thus, it is possible to detect when the reset button 19 is pressed.

A rotor transmission wheel 614 for interlocking with the power-generating rotor 613 is also mounted on the upper side of the return-to-zero holder 360.

Figure 13:
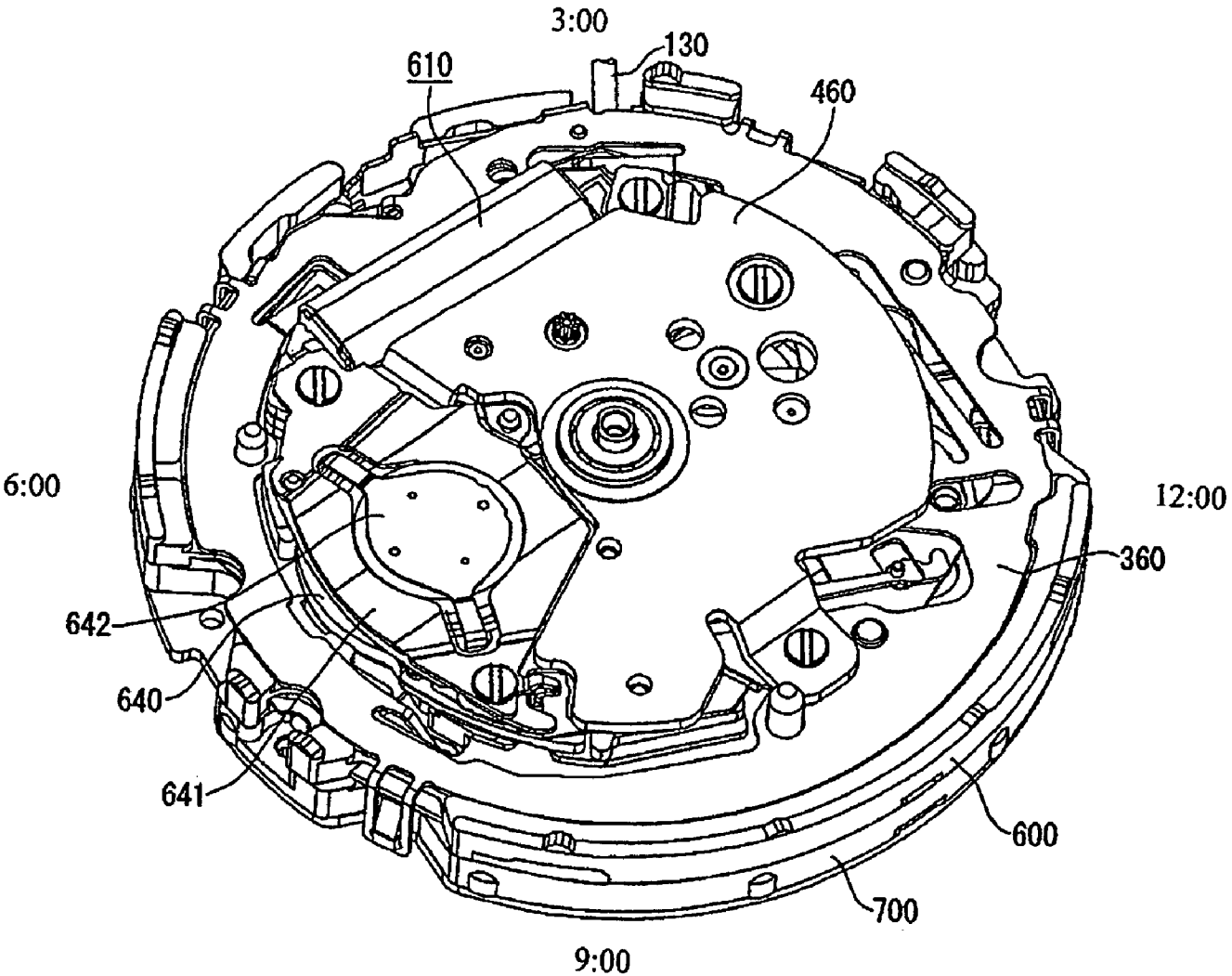
FIG. 13 is a perspective view showing a state during the step of assembling the movement.

Furthermore, an oscillating-weight support 460 is mounted on the return-to-zero holder 360, as shown in FIG. 13. The upper tenons on the shafts of the power-generating rotor 613, the rotor transmission wheel 614, the minute CG wheel 220, and the minute CG first intermediate wheel 221 are supported by the oscillating-weight support 460 in a rotatable manner.

Also, the secondary power source 640 is mounted in the bed 620. The secondary power source 640 is configured so that a secondary power source unit is integrated by welding with a secondary battery and a negative terminal. The secondary power source 640 is fixed to the movement 100 by a secondary battery holder 641, which is a metal member, with two screws via an insulation board, and is designed to be assembled after all other movement components. A negative lead plate 642 for the secondary battery is also attached to the secondary power source 640.

Figure 14:
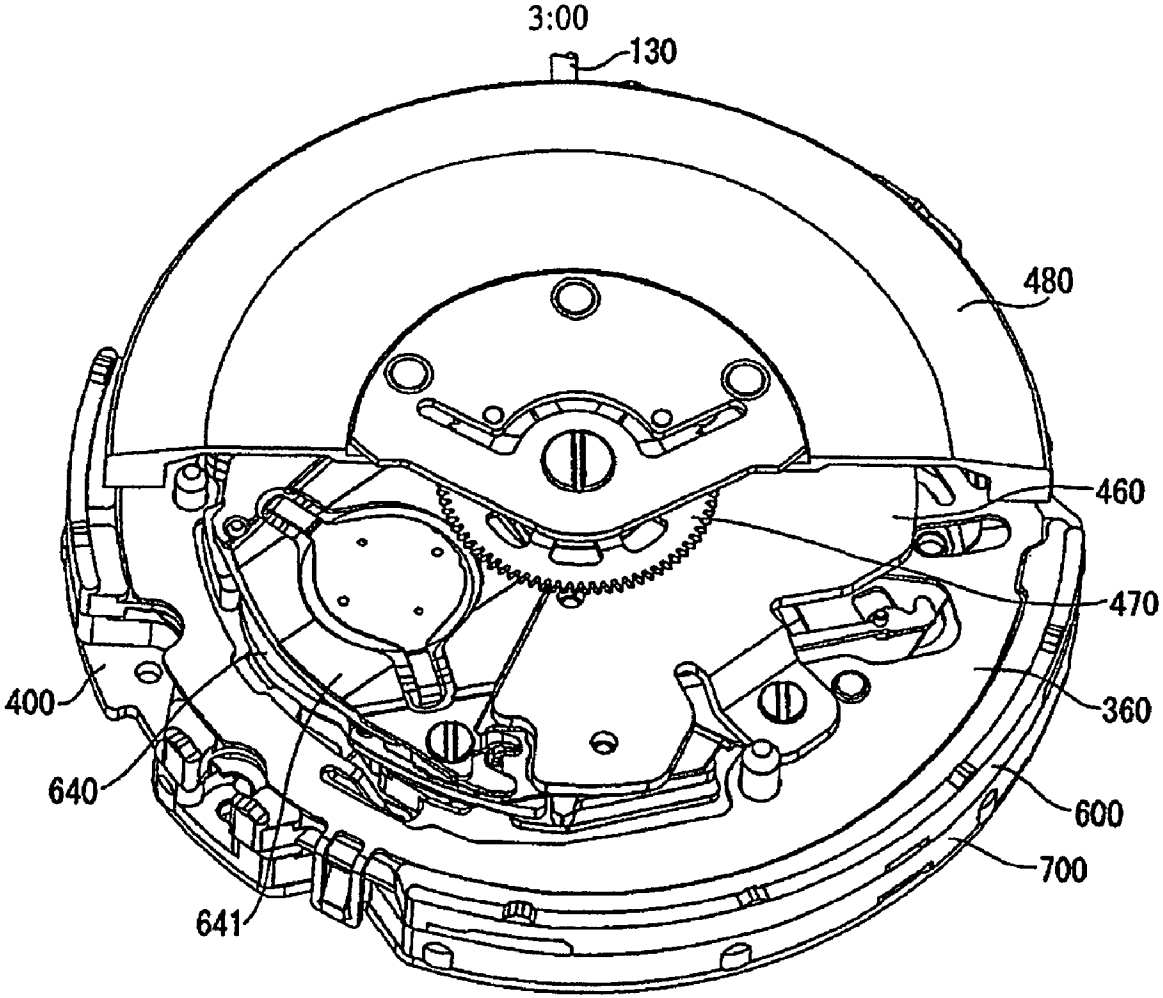
FIG. 14 is a perspective view showing a state during the step of assembling the movement.

An oscillating weight wheel 470 and an oscillating weight 480 are mounted on the oscillating-weight support 460, as shown in FIG. 14. The oscillating weight wheel 470 interlocks with the pinion of the rotor transmission wheel 614 protruding from the oscillating-weight support 460. Therefore, the power-generating rotor 613 rotates via the rotor transmission wheel 614, and the power generator 610 generates electricity when the oscillating weight wheel 470 rotates along with the rotation of the oscillating weight 480.

[3-1. Operation of Basic Timepiece]

In the present embodiment, the oscillating weight 480 rotates when the timepiece 1 is mounted or otherwise placed on the arm and moved. The power-generating rotor 613 rotates via the oscillating weight wheel 470 and rotor transmission wheel 614 along with the rotation of the oscillating weight 480, and electric power is generated.

The electric power generated by the power generator 610 is rectified by the rectifying circuit electrically connected via the conduction board 630 or conduction coils 631, and is then supplied and charged to the secondary power source 640.

The electric power charged to the secondary power source 640 is supplied to the printed circuit board 501 via the conduction board 630 or conduction coils 631. The liquid crystal oscillator, IC, or other such control device mounted on the printed circuit board 501 is thereby driven, and a drive pulse outputted from this control device drives the basic timepiece electric motor 101.

When the basic timepiece electric motor 101 is driven and the rotor 104 rotates, the rotation is transmitted to the small second wheel and pinion 106 via the fifth wheel and pinion 105, and the second hand 13 operates as previously described.

The rotation of the rotor 104 is simultaneously transmitted via the fifth wheel and pinion 105, the intermediate wheels 107 through 109, the third wheel and pinion 110, the center wheel and pinion 111, the minute wheel, and other such basic timepiece train wheels, whereby the hour hand 11 and the minute hand 12 operate.

[3-2. Operation of Chronograph Timepiece]

On the other hand, when the chronograph timepiece function is utilized, the start and stop button 18 is first pressed. The hammer 330 is then moved via the operating lever 340, the hammer 330 is separated from the heart-cams 210 and 224, and the setting of the second CG wheel 208 and minute CG wheel 220 is released.

The switch input terminal 341 is simultaneously brought into contact with the printed circuit board 501 to turn on the switch input by pressing the start and stop button 18, and a drive signal is sent from the control circuit to the electric motor 201 to drive the electric motor 201.

The rotation of the rotor 204 of the CG electric motor 201 is transmitted to the second CG wheel 208 and minute CG wheel 220 via the CG train wheel, and the second CG hand 14 and minute CG hand 15 are both operated.

When the start and stop button 18 is released, the operating lever 340 returns to its original position due to the elastic force of the click spring 361, and the switch input terminal 341 is separated from the printed circuit board 501. Specifically, the CG electric motor 201 continues to be driven and the chronograph timekeeping continues.

While the CG electric motor 201 is being driven, the operating lever 340 rotates again and the switch input is turned on when the start and stop button 18 is pressed. Thus, the CG electric motor 201 stops, and the second CG hand 14 and minute CG hand 15 also stop.

If the start and stop button 18 is then pressed once again, the CG electric motor 201 begins to be driven again and the second CG hand 14 and minute CG hand 15 also begin to operate again. Thereafter, every time the start and stop button 18 is pressed, the CG electric motor 201 stops, driving repeats in an alternating fashion, and the chronograph time is cumulatively measured.

On the other hand, when the reset button 19 is pressed, the hammer 330 is moved via the transmission lever 310 and the transmission hammer 320, the hammer 330 applies pressure to the heart-cams 210 and 224 of the second CG wheel 208 and minute CG wheel 220, and the hands 14 and 15 are returned to zero.

The present embodiment is designed so that a chronograph train wheel setting lever that is set by pressure from the second CG second intermediate wheel 206 is provided, and the rotor 204 of the CG electric motor 201 does not rotate along with the resetting operation of the second CG wheel 208 and minute CG wheel 220 when the reset button 19 is pressed. The chronograph train wheel setting lever 350 is axially supported by an axle provided to the circuit cover 600, and is driven by the transmission hammer 320. Furthermore, when the reset button 19 is pressed, the input terminal section 364 comes into contact with the reset terminal due to the releasing of the input terminal section 364 by the spring 363, and the electric circuit for controlling the CG electric motor 201 is reset when the reset switch is inputted.

Furthermore, after the start operation is performed, the second CG hand 14 and minute CG hand 15 automatically stop simultaneously without the stop operation being performed when the maximum measurable time of 45 minutes has passed. At this point, the second CG hand 14 automatically stops exactly above the indicator 3Ca, which is the return-to-zero position. The minute CG hand 15 continues to move at the speed of the measured time past the indicator 3Da (the second CG hand 14 also continues to move in the process), and stops after reaching the end of the extra display section 3E.

The electrical state during automatic stopping is the same as the one during manual stopping, but the mechanical state is such that the chronograph train wheel setting lever 350 applies pressure to the second CG second intermediate wheel 206, and the chronograph train wheel is controlled by the chronograph train wheel setting lever 350 through a reset operation performed after automatic stopping. Also, the CG hands 14 and 15 are automatically stopped by a procedure in which motor pulses outputted to the chronograph motor 201 are counted following the start operation, and in which it is determined that a specific pulse count has been outputted.

If the return-to-zero operation is then performed, the second CG hand 14 reaches the return-to-zero condition by maintaining its position unchanged, and the minute CG hand 15 instantaneously returns to zero by rotating in the opposite direction to the direction of rotation.

An example of automatic stopping will now be described in more detail using FIGS. 15 through 17.

Figure 15:
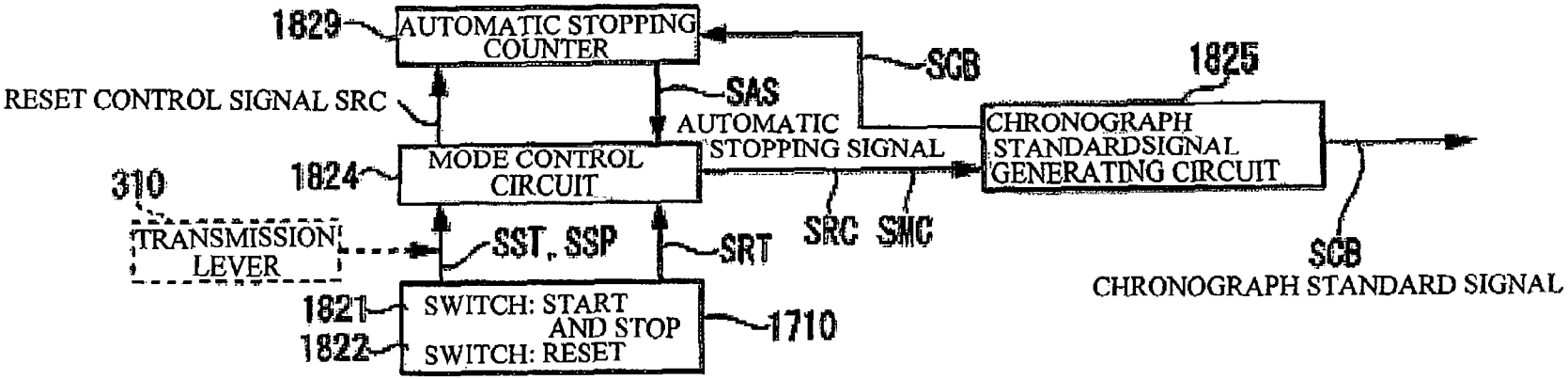
FIG. 15 is a block diagram showing a chronograph control circuit.

The chronograph timepiece 1 has a switch 1710, a mode control circuit 1824, a chronograph standard signal generating circuit 1825, and an automatic stopping counter 1829 as a chronograph control circuit, as shown in the block diagram in FIG. 15.

The switch 1710 basically consists of a start and stop switch 1821 and a reset switch 1822, operated by the start and stop button 18 and the reset button 19, respectively. The start and stop switch 1821 is adapted to turn on or off when the start and stop button 18 is operated, and the reset switch 1822 to turn on or off when the reset button 19 is operated.

The start and stop switch 1821 is adapted to turn on as a result of one operation of the transmission lever 310, for example, and to turn off due to a second operation. This is then repeated every time the start and stop switch 1821 is pressed. The reset switch 1822 also operates in a substantially similar manner.

The mode control circuit 1824 outputs a start and stop control signal SMC or a reset control signal SRC to the chronograph standard signal generating circuit 1825 on the basis of a start signal SST and a stop signal SSP, or a reset signal SRT from the switch 1710. Also, the mode control circuit 1824 controls the operation mode of the chronograph portion by outputting the reset control signal SRC to the automatic stopping counter 1829, chronograph standard signal generating circuit 1825, and the like. The mode control circuit 1824 has a circuit for preventing the reset switch 1822 from chattering.

The chronograph standard signal generating circuit 1825 controls the chronograph motor 201 by outputting a chronograph standard signal SCB to a motor pulse generating circuit (pointer drive device) 1826 (FIG. 16) on the basis of the start and stop control signal SMC from the mode control circuit 1824. The chronograph standard signal generating circuit 1825 drives the chronograph motor 201 when the start and stop control signal SMC is inputted, and stops the chronograph motor 201 during the stop operation.

The automatic stopping counter (pointer stopping device) 1829 performs the counting of the chronograph portion due to the inputting of the chronograph standard signal SCB from the chronograph standard signal generating circuit 1825. The chronograph standard signal SCB is a synchronization signal for producing the generation timing of the motor pulse SPC (FIG. 16), and the automatic stopping counter 1829 counts the chronograph standard signal SCB. The automatic stopping counter 1829 outputs an automatic stopping signal SAS to the mode control circuit 1824 after the passage of the maximum measurable time; for example, 45 minutes plus a specific period.

Figure 16:
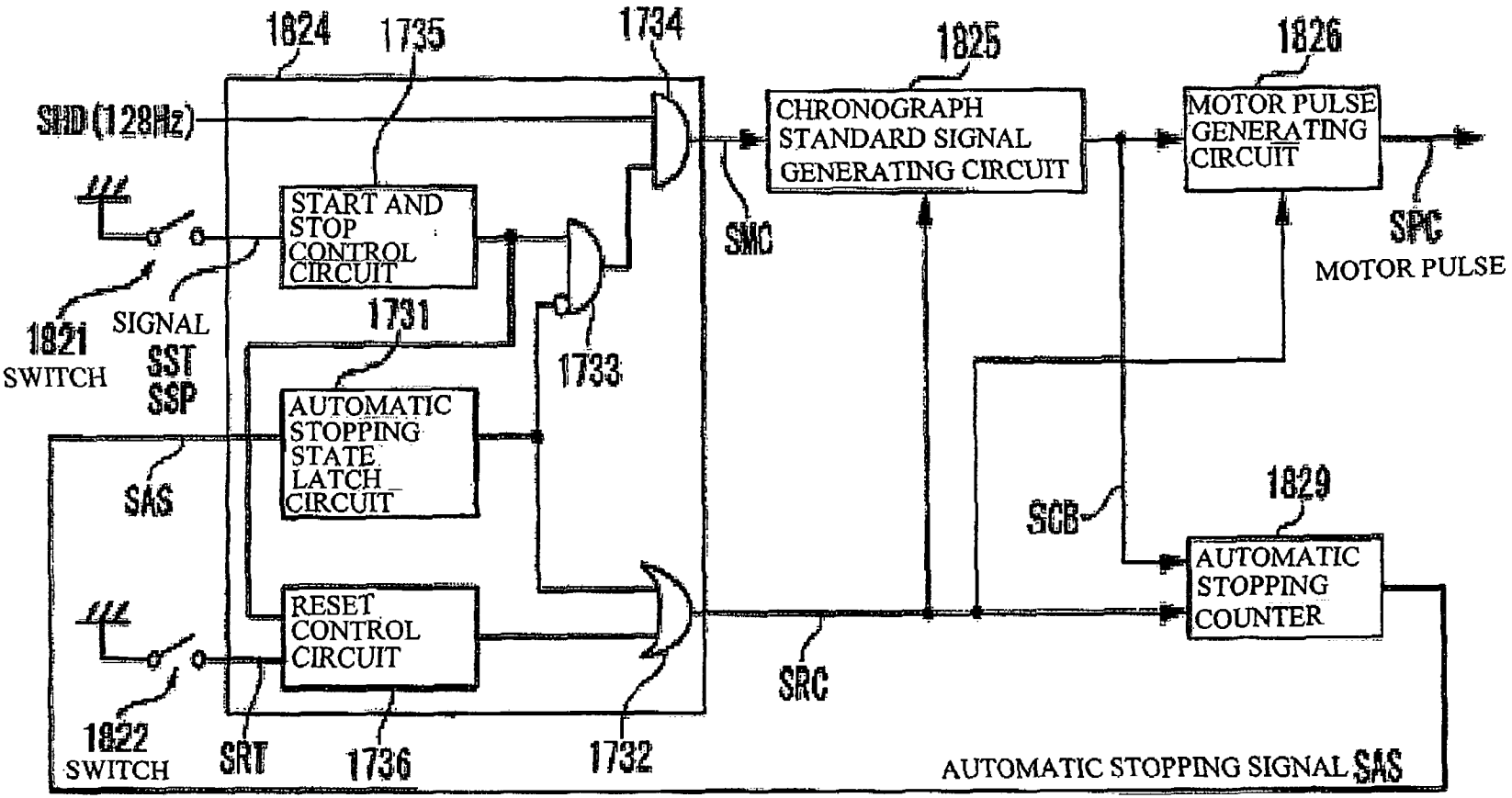
FIG. 16 is a block diagram showing a chronograph control circuit and the peripheral circuitry.

FIG. 16 is a block diagram showing the chronograph control circuit in FIG. 15 and the peripheral circuitry.

The mode control circuit 1824, as part of the chronograph control section, has a start and stop control circuit (drive initiation device) 1735, a reset control circuit 1736, an automatic stopping state latch circuit 1731, an OR circuit 173, and two AND circuits 1733 and 1734.

The start and stop control circuit 1735 is a circuit for detecting the on/off state of the start and stop switch 1821. The start and stop control circuit 1735 outputs a signal of the state of measurement or non-measurement, depending on whether the start and stop switch 1821 has been operated, to the AND circuit 1733 or the like.

The reset control circuit 1736 is a circuit for detecting the on/off state of the reset switch 1822. The reset control circuit 1736 outputs a signal for resetting chronograph control and the like, depending on whether the reset switch 1822 has been operated, to the OR circuit 1732.

According to the automatic stopping signal SAS from the automatic stopping counter 1829, the automatic stopping state latch circuit 1731 outputs an L-level signal when the AND circuit 1733 and OR circuit 1732 are not in an automatically stopped state, and outputs an H-level signal for an automatically stopped state.

A signal from the automatic stopping state latch circuit 1731 and a signal from the reset control circuit 1736 are inputted to the OR circuit 1732, and are then outputted to the chronograph standard signal generating circuit 1825, the motor pulse generating circuit 1826, the automatic stopping counter 1829, and the like. The first AND circuit 1733 is presented with an inverted input signal from the automatic stopping state latch circuit 1731, and an output signal from the start and stop control circuit 1735. The first AND circuit 1733 then provides an output to the second AND circuit 1734. The second AND circuit 1734 is presented with the output signal from the first AND circuit 1733 and with a signal SHD (for example, a 128 Hz pulse signal) generated by a high-frequency clock division circuit (not shown).

With such a configuration, the operation of the circuits in FIG. 16 will now be described.

In the reset state, the start and stop switch 1821 turns on when the start and stop button 18 is operated. A start signal SST is then inputted to the mode control circuit 1824. The start and stop control circuit 1735 performs sampling to confirm that the start and stop switch 1821 is on. Consequently, the mode control circuit 1824 raises the output of the AND circuit 1733 to an H level, and outputs a start and stop control signal SMC, which is a pulse signal of 128 Hz, for example, from the AND circuit 1734 to the chronograph standard signal generating circuit 1825, and the chronograph standard signal generating circuit 1825 outputs a chronograph standard signal SCB, which is a pulse signal of ⅕ Hz, for example. Thus, the motor pulse generating circuit 1826 outputs a motor pulse SPC for controlling the driving of the chronograph motor 201 on the basis of the chronograph standard signal SCB, and the pointer movement in the chronograph portion is initiated.

The automatic stopping counter 1829 then counts the chronograph standard signal SCB from the chronograph standard signal generating circuit 1825, and outputs the automatic stopping signal SAS to the automatic stopping state latch circuit 1731 of the mode control circuit 1824 when the count value corresponds to the automatic stopping position.

The automatic stopping state latch circuit 1731 outputs an H-level signal, for example, to the OR circuit 1732 and the AND circuit 1733; the OR circuit 1732 therefore outputs an H-level signal; the chronograph standard signal generating circuit 1825, the motor pulse generating circuit 1826, and the automatic stopping counter 1829 are reset; and the rotation of the CG hands 14 and 15 is stopped. Also, since the output signal of the AND circuit 1733 is at an L level, the output of the AND circuit 1734 is also at an L level, and the start and stop control signal SMC is no longer outputted from the mode control circuit 1824 to the chronograph standard signal generating circuit 1825.

Figure 17:
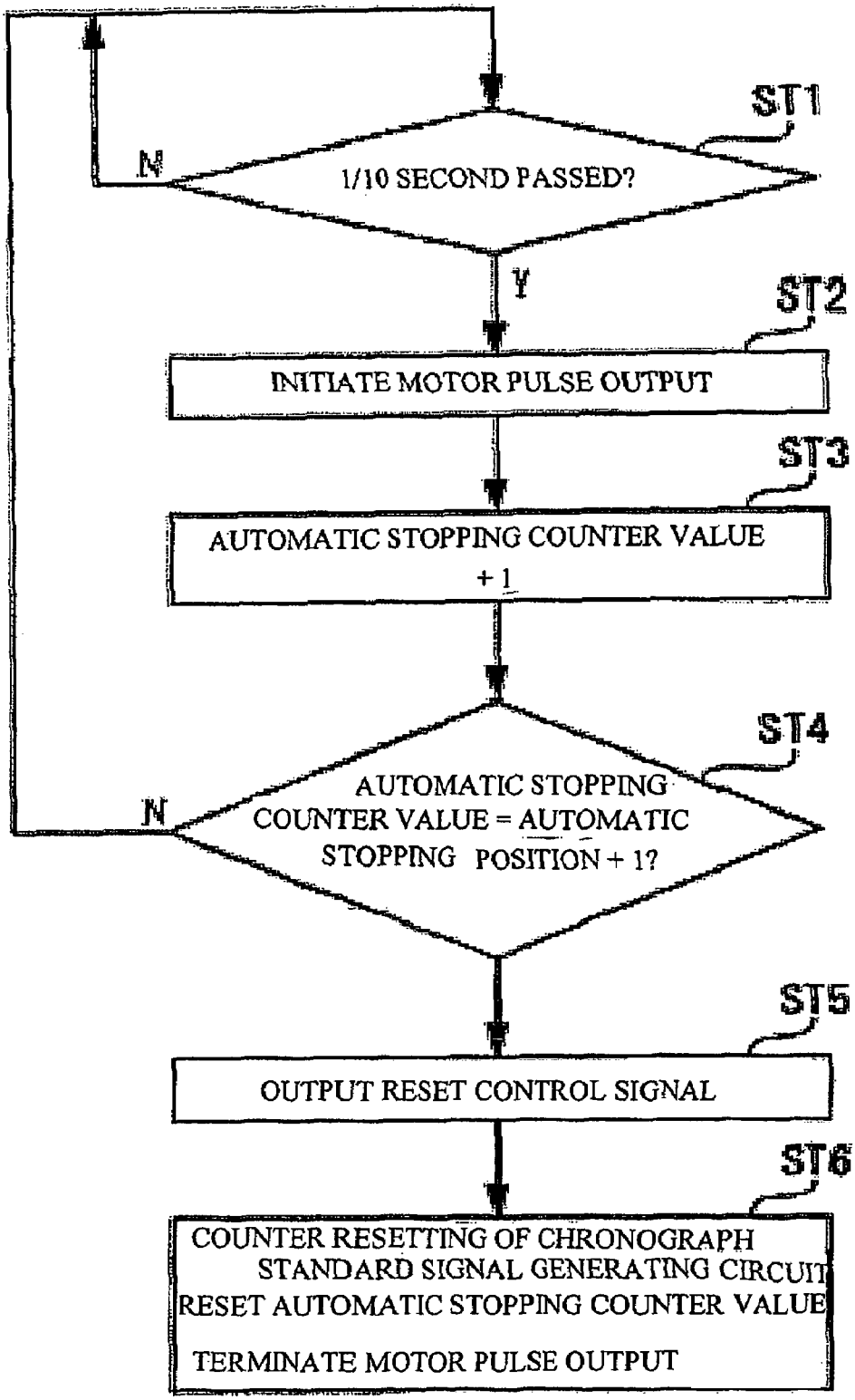
FIG. 17 is a flow chart showing the automatic stopping process of the chronograph.

FIG. 17 is a flow chart showing the automatic stopping process of the chronograph. The automatic stopping process will now be described with reference to FIG. 17.

<Processing of Hand Positions Until the Automatic Stopping Position is Reached>

When the start and stop button 18 is operated, a start signal SST is inputted to the mode control circuit 1824. Thus, the mode control circuit 1824 outputs a start and stop control signal SMC to the chronograph standard signal generating circuit 1825.

The chronograph standard signal generating circuit 1825 divides the start and stop control signal SMC, which is 128 Hz, for example, and creates a chronograph standard signal SCB of ⅕ Hz, for example. A standby state occurs when there is no motor pulse SPC output or no change in the chronograph standard signal SCB for performing the counting process of the automatic stopping counter 1829 by the trailing or rising of the chronograph standard signal SCB (step ST1). When the chronograph standard signal SCB is outputted, the motor pulse generating circuit 1826 generates a motor pulse SPC synchronously with the trailing thereof, and initiates output. The chronograph motor 201 is driven due to the output of the motor pulse SPC. The CG hands 14 and 15 are driven in this manner (step ST2).

The automatic stopping counter 1829 counts up the automatic stopping counter value by +1 from the trailing of the chronograph standard signal SCB on the basis of the rise in the chronograph standard signal SCB after 1/128 second, for example (step ST3). When the counted-up automatic stopping counter value is not 1 plus the counter value corresponding to the automatic stopping position of the CG hands 14 and 15, the process returns to step ST1 and the operation described above is repeated (step ST4). Thus, the CG hands 14 and 15 rotate and time measurement continues.

<Processing Performed when Hands Have Reached Automatic Stopping Position>

When the automatic stopping counter value is 1 plus the counter value corresponding to the automatic stopping position (step ST4), the automatic stopping counter 1829 outputs an automatic stopping signal SAS to the mode control circuit 1824. The mode control circuit 1824 thereby brings the output signal of the automatic stopping state latch circuit 1731 to an H level, and the H level reset control signal SRC is outputted from the OR circuit 1732 to the chronograph standard signal generating circuit 1825, the motor pulse generating circuit 1826, and the automatic stopping counter 1829 (step ST5). The chronograph standard signal generating circuit 1825, the motor pulse generating circuit 1826, and the automatic stopping counter 1829 are reset by this operation, the output from the motor pulse generating circuit 1826 to the chronograph motor 201 is discontinued, and the counter value of the automatic stopping counter 1829 becomes "0 (zero)" (step ST6). The CG hands 14 and 15 thereby automatically stop at their respective predetermined automatic stopping positions. The automatic stopping unit relating to the present invention is thus configured with the automatic stopping state latch circuit 1731 and the automatic stopping counter 1829.

The movement of the CG hands 14 and 15 may be stopped by mechanical automatic stopping devices, and is not limited to processes such as those described above. A possible example of such a mechanical device is a structure wherein a protrusion that doubles as an electric switch is provided within the movement path of the heart-cam 224, the heart-cam 224 comes into contact the protrusion, and a reset signal is generated by this electric contact.

[3-3. Time Correction Operation of Basic Timepiece]

To correct the time indicated by the basic timepiece, the crown 17 is pulled out to the time correction position, and the setting stem 130 is also pulled out. As a result, when the setting stem 130 is rotated, the rotation is transmitted to the center wheel and pinion 111 via the setting-wheel 134, the intermediate wheels 135 through 137, and the minute wheel 138 and the standard time is corrected because the setting lever 131 and bolt 132 are interlocked and the clutch wheel 133 and setting-wheel 134 are engaged. The rotation of the setting stem 130 herein is not transmitted to the basic timepiece electric motor 101 because the train wheel setting lever 139 operates in an interlocked fashion with the pulling out of the setting stem 130 to set the fourth first intermediate wheel 109.

The present embodiment as such has the following effects.

(1) Specifically, in the chronograph timepiece 1, the CG hands 14 and 15 automatically stop after the maximum measurable time of 45 minutes has passed since the starting of the chronograph function, but the rotational trajectory of the minute CG hand 15 is a fan pattern and the minute CG hand 15 does not rotate in full circle unlike in conventional practice or the second CG hand 14, so the automatic stopping position of the minute CG hand 15 is not the zero position and is not a position slightly past the zero position.

Therefore, if the minute CG hand 15 has stopped past the indicator 3Da provided along the rotational trajectory, it is possible to determine that the position thereof is specifically an automatically stopped position. Also, if the minute CG hand 15 has stopped above any of the marks in the indicator 3D located within the rotational trajectory, it is possible to determine that the position thereof is a position where the hand has stopped due to the stop operation. Moreover, since the condition in which the hand has stopped at the zero position is no different than the return-to-zero condition, it is possible to determine that the hand that has stopped at the zero position is the result of a return-to-zero operation and a state wherein the electronic circuits have been reset has been reached. As a result, it is possible to more reliably determine what type of stopped state the minute CG hand 15 is in on the basis of the stopped position of the minute CG hand 15.

(2) Another feature of the chronograph timepiece 1 is that the minute CG hand 15 automatically stops at a position past the indicator 3Da that corresponds to the maximum measurable time when the maximum measurable time has passed. Therefore, if the minute CG hand 15 has stopped above such indicator 3Da as a result of the stop operation, the measurement results are seen to be equivalent to the exact maximum measurable time, specifically, 45 minutes, and the maximum measurable time can be accurately measured.

In other words, normally, if the minute CG hand 15 stops above the indicator 3Da during automatic stopping, such as when a runner reaches his goal and stops the timepiece, the runner, after stopping the timepiece 1 and looking at the timepiece to confirm the measurement results, sees that the minute CG hand 15 has stopped exactly above the indicator 3Da, finds himself in a situation in which he cannot determine whether the timepiece has stopped due to automatic stopping or due to the stop operation, and is incapable of measuring the maximum measurable time. However, there is no concern over whether such a situation will occur with the timepiece 1.

(3) Furthermore, in the timepiece 1, an extra display section 3E different from the indicator 3D is provided to an area past the indicator 3Da of the maximum measurable time, and the minute CG hand 15 automatically stops above the extra display section 3E, so the stopped state of the minute CG hand 15 due to automatic stopping is easier to observe and the readability can be further improved to make the timepiece easier to use.

The indicator 3D is narrow and is shaped as black lines, and the extra display section 3E is wide, has an indicator width of 3 minutes, and is red unlike the indicator 3D. Therefore, when the minute CG hand 15 exceeds the maximum measurable time and is above the extra display section 3E, it is possible to more accurately determine that the hand is not above the normal indicator 3D, and, as a result, the readability can be further improved and the outward design can also be improved.

(4) Since only the rotational trajectory of the minute CG hand 15 for indicating the chronograph minutes, which are larger units than the chronograph second, is a fan pattern, providing the indicator 3C for indicating the chronograph second in a circle dispenses with the need to make the indicator 3C thin and dense, and the chance of hindering readability can be prevented.

(5) Also, since the second CG hand 14 automatically stops above the indicator 3Ca at the zero position when the maximum measurable time has passed, it is easy to determine from this stopped state that the hand is in the automatic stopping state in conjunction with the stopped state of the minute CG hand 15. Additionally, the second CG hand 14 can be made more visible than when it stops at a position halfway through the circular rotational trajectory, and the design of the automatically stopped state can be improved.

(6) Since the CG hands 14 and 15 are returned to zero with a mechanical return-to-zero mechanism that has the heart-cams 210 and 224 and the hammer 330, even a very long minute CG hand 15 can be mechanically reset very rapidly, which provides a dynamic feel.

(7) Particularly since the rotational trajectory of the minute CG hand 15 is a fan pattern, the minute CG hand 15 must be returned to zero by changing its drive direction in order to return the minute CG hand 15 in the chronograph motor 201 to zero, and the chronograph motor 201 is limited to a design in which only direct rotation and reverse rotation can be implemented. However, a motor capable of such direct and reverse rotation must use a primary battery or the like with low voltage fluctuation as a power source, but if the rotation of an oscillating weight 480 is converted to electrical energy by a power generator 610 and supplied to a secondary power source 640, and the secondary power source 640 is used to drive the motor, voltage fluctuation makes it impossible to drive such a motor, which creates restrictions in the design of the timepiece 1. In the present embodiment, in which mechanical resetting is employed, the chronograph motor 201 may perform only direct rotation (in one direction), and is therefore designed to be resistant to voltage fluctuation and to be accurately driven using either a primary power source (primary battery) or the secondary power source 640, without any restrictions being imposed on the design of the timepiece 1.

(8) Furthermore, as a result of the chronograph motor 201 being resistant to voltage fluctuation, the chronograph motor 201 can be reliably driven even when the electrical charge of the secondary power source 640 is extremely low, and measuring with the CG hands 14 and 15 is immediately possible by providing, for example, a slight charge even when the hands have stopped due to a charging failure.

(9) Because of mechanical resetting, the angle during movement of the minute CG hand 15 in a fan pattern can be easily and rapidly changed by varying the reduction rate of the chronograph train wheel, which makes commercial development possible with a wide range of designs for the chronograph timepiece 1, and can improve the level of customer satisfaction. In other words, with electrical resetting, in which a specific number of motor pulses are outputted by IC control, the IC design must be modified when the angle of rotation in a fan pattern is changed, but modifying the design is difficult, time-consuming, and disadvantageous in terms of responding to customer demand.

(10) The readings provided of the hands can be easily seen by the user because the second CG hand 14 is provided independently, the shaft 14A thereof does not coincide with the shafts of the other hands, and the standard time display separates the second hand 13 from the hour and minute hands 11 and 12. The minute CG hand 15 is also provided independently and the indication thereof can therefore be read more easily. Consequently, the multifunction timepiece 1 with a chronograph timepiece function and numerous pointers can be made into a timepiece with good visibility whereby the indications of the pointers can be accurately confirmed.

Also, the train wheels for driving the hands 11 through 15 can be mounted separate from each other, and the overlapping of the train wheels or the overlapping of the hands in cross section can be minimized because, except for the hour and minute hands 11 and 12, the hands 11 through 15 are mounted independently. Therefore, the multifunction timepiece 1 can be made thinner in shape even if it has many pointers.

(11) Since the shaft 14A of the second CG hand 14 is disposed somewhat eccentric from the center 4A of the time display section 4, the lengths of the hour hand 111 and minute hand 12, which must be disposed so as not to interfere with the shaft 14A, can be increased by a value corresponding to the length of eccentricity. Therefore, the hands 111 and 12 can be made relatively long and the visibility of the standard time can be improved even when the hour and minute hands 11 and 12 for displaying the standard time are separated from the second CG hand 14 and are disposed in the 6:00 position of the time display section 4.

Furthermore, the second CG hand 14 is set with the shaft 14A disposed somewhat eccentric from the center 4A of the time display section 4 and is made longer than the hands 11 through 13 and 15. In this regard as well, a dynamic operation can be achieved for the hand 14 during mechanical resetting, and visibility can be improved.

(12) Since the minute CG hand 15 moves in a fan pattern, the shaft 15A thereof can be disposed near the shaft 14A of the second CG hand 14. Specifically, the distance between the shafts 14A and 15A can be less than the length L4 of the minute CG hand 15. Therefore, the shaft 15A of the minute CG hand 15 can be disposed adjacent to the center 4A of the time display section 4, and the indication of the minute CG hand 15 can be easily read because the length L4 of the minute CG hand 15 is proportionately increased.

Also, the cam contact points of the hammer 330 in contact with the heart-cams 210 and 224 can be adjacent to each other, and the hammer 330 in contact with the heart-cams 210 and 224 can be easily integrated and reduced in size because the shafts 14A and 15A are adjacent to each other when the chronograph hands 14 and 15 are returned to zero in a mechanical resetting configuration.

(13) At least two of the toothed wheels 107 through 109 that do not increase or decrease speed are disposed between the rotor 104 of the basic timepiece electric motor 101 and the gears on which the hour and minute hands 11 and 12 are mounted (center wheel and pinion 111, hour wheel), and the cost of the components can be reduced because these toothed wheels 107 through 109 are configured from similar gears. Therefore, the cost can be reduced even when there is a large distance between the second hand 13 and the hour and minute hands 11 and 12.

(14) In a regular timepiece, the conduction structure of the secondary power source and the printed circuit board is given priority, and the secondary power source is disposed on the bottom layer (first layer) of the printed circuit board, but when the secondary power source is disposed on the bottom layer, electrical conduction from the secondary power source must be cut off when the circuit is electrically inspected after the components are assembled. Therefore, components such as positive terminals are designed to be incorporated last, and caution must be taken so that the secondary power source is not conductive during the assembly steps.

Accordingly, in the present embodiment, the secondary power source 640 is incorporated last in the steps of assembling the movement 100 because the secondary power source 640 is disposed in the second layer (top layer) next to the back cover 30, and an electrical inspection on the circuits during the assembly step can be easily performed. Therefore, assembly, construction, and productivity can be improved.

(15) The hammer 330, operating lever 340, and other components that strike the heart-cams 210 and 224 can be efficiently mounted because the resetting mechanism is mounted on the top layer of the CG train wheel. Therefore, a multifunction timepiece 1 having a plurality of components can be accommodated to the size of a normal wristwatch.

(16) Circuits separated in the vertical direction can be reliably connected to each other in a simple configuration because the printed circuit board 501 and the secondary power source 640 in the second layer or the like are electrically connected by utilizing the conduction coils 631.

(17) A good balance is established between the positions of the hands, and design is improved because the second CG hand 14 is disposed at a position eccentric to the 12:00 direction from the center 4A of the time display section 4, the hour hand 11 and minute hand 12 are disposed at a position eccentric to the 6:00 direction from the center 4A, the second hand 13 is disposed at a position eccentric roughly in the 10:00 direction in relation to the center 4A, and the minute CG hand 15 is disposed at a position eccentric roughly in the 2:00 direction in relation to the center 4A.

Additionally, since the minute CG hand 15 that moves in a fan pattern is disposed in roughly the 2:00 direction, the operation of the hands can be easily understood because the minute CG hand 15 rotates from the reset position around the timepiece, that is, in the same direction as the other hands.

The present invention is not limited to the embodiments previously described and includes other configurations and modifications that allow the objectives of the present invention to be achieved, and modifications such as those shown below are also included in the present invention.

For example, the maximum measurable time of the minute chronograph time was 45 minutes in the embodiments previously described, but this maximum measurable time may be arbitrary and is not limited to 45 minutes.

Also, the indicator 3D of the minute chronograph time was provided along a circular arcuate portion in a fan pattern that extended across a 135° angle, but the angle of the fan pattern is not limited to 135° and may be arbitrarily determined with consideration to the reduction rate between the second CG wheel 208 and minute CG wheel 220, the maximum measurable time, and the like. For example, the display may be a fan pattern of 270° with a reduction rate of 1/60, or a fan pattern of 180° with a reduction rate of 1/90, even with the same 45-minute timer. The display may also be made into a fan pattern of 180° by using a 60-minute timer in which the reduction rate is kept unchanged at 1/120.

Two pointers, the second CG hand 14 and minute CG hand 15, were provided in the embodiments previously described, but an hour CG hand for indicating the hour chronograph time may also be provided, in which case the hour CG hand would be rotated in a fan pattern as an indicator of the largest units. Alternatively, a second CG hand 14 alone may be provided or a ⅕ or 1/10 second CG hand may be provided, in which case the CG hand is rotated in a fan pattern as an indicator of the largest units.

In the embodiments previously described, the second CG hand 14 is provided so as to stop exactly over the indicator 3Ca, which is the zero position, when the minute CG hand 15 stops over the extra display section 3E, but the stopping position of circularly rotating pointers such as the second CG hand 14 is arbitrary and is not limited to the zero position.

The second CG hand 14 for indicating low-order units of second chronograph time rotates in a circle in the embodiments previously described, but the concept of such a pointer for low-order units rotating in a fan pattern is also included in the present invention.

The extra display section 3E was provided to the extended section of the indicator 3Da in the embodiments previously described, but such an extra display section 3E is not an indispensable component of the present invention and can be omitted. Specifically, cases in which the area for the automatic stopping of the minute CG hand 15 has the same color as the surface of the dial 3 are also included in the present invention.

The timing device of the present invention is not limited to the chronograph timepiece 1 in the embodiments previously described and may, for example, be any device whereby time information can be measured, such as a pointer-type stopwatch or timer.

In addition, the preferred configurations, methods, and the like for carrying out the present invention are disclosed in the above descriptions, but the present invention is not limited thereto. Specifically, the present invention is particularly illustrated and described pertaining primarily to specific embodiments, but those skilled in the art can make various modifications to the shapes, materials, quantities, and other specific details of the embodiments described above without deviating from the scope of the technical ideas and objectives of the present invention.

Therefore, the descriptions that are disclosed above and refer to specific shapes, materials, and other items are given solely with the intent of making the present invention easy to understand and are not intended to limit the present invention. For this reason, descriptions that contain names of members in which some or all of the limitations on shapes, materials, and other items have been removed are also included in the present invention.

The terms "front," "back," "up," "down," "perpendicular," "horizontal," "slanted," and other direction-related terms used above indicate the directions in the diagrams used. Therefore, the direction-related terms used to describe the present invention should be interpreted in relative terms as applied to the diagrams used.

"Substantially," "essentially," "about," and other terms that are used above and represent an approximation indicate a reasonable amount of deviation that does not bring about a considerable change as a result. Terms that represent these approximations should be interpreted so as to include a minimum error of about +5%, as long as there is no considerable change due to the deviation.

The disclosures in Japanese Patent Application Nos. 2003-152850 and 2004-129772 are incorporated herein in their entirety by reference.

The embodiments described above are only some of the embodiments of the present invention, but it is apparent to those skilled in the art that it is possible to add modifications to the above-described embodiments by using the above-described disclosure without exceeding the range of the present invention as defined in the claims. The above-described embodiments furthermore do not limit the range of the present invention, which is defined by the accompanying claims or equivalents thereof, and are designed solely to provide a description of the present invention.

What is claimed is:

1. A timing device, comprising:

a time display section having a dial with a measurement indicator from a zero time position to a maximum measurable time position, and pointers capable of rotating above the dial in a fan-shaped trajectory; and a drive unit being configured to drive the pointers above the dial from the zero time position to the maximum measurable time position, and to stop the pointers after the maximum measurable time has passed;

wherein the drive unit stops the pointers at a position past the maximum measurable time position above the measurement indicator after the maximum measurable time has passed;

wherein the dial further has an extra display section to indicate that the maximum measurable time has been exceeded, and the drive unit stops the pointers above the extra display section after the maximum measurable time has passed; and wherein the extra display section is formed with a large width so as not to be entirely covered by the pointers.

2. The timing device according to claim 1, wherein the extra display section has a different color from that of the measurement indicator.

3. The timing device according to claim 1, wherein the extra display section has a different width from that of the measurement indicator.

4. The timing device according to claim 1, wherein the drive unit drives the pointers according to chronograph information.

5. The timing device according to claim 4, wherein the time display section further has second pointers, and the drive unit drives the pointers according to minute information and drives the second pointers according to second information.

6. The timing device according to claim 5, wherein the pointers are disposed with the rotational center nearer to the center of the second pointers than to the tips thereof.

7. The timing device according to claim 1, wherein the drive unit comprises a return-to-zero mechanism to return mechanically the pointers to the zero time position.

8. The timing device according to claim 7, wherein the drive unit further comprises a motor pulse generating circuit, and a motor that is driven by a motor pulse from the motor pulse generating circuit.

9. A timepiece comprising:

a time section having a dial with a time indicator to display time a measurement indicator from a zero time position to a maximum measurable time position, an hour hand capable of rotating along the time indicator, and pointers capable of rotating along the measurement indicator in a fan-shaped trajectory; and a drive unit being configured to drive the hour hand according to time information to drive the pointers from zero time position to the maximum measurable time position according to measured time information, and to stop the pointers at a position where the maximum measurable time has passed, the drive unit being configured to stop the pointers at a position past the maximum measurable time position after the maximum measurable time has passed;

wherein the drive means stops the pointers at a position past the maximum measurable time position after the maximum measurable time has passed;

wherein the dial further has an extra display section for indicating that the maximum measurable time has exceeded; and the drive means stops the pointers above the extra display section after the maximum measurable time has passed.

10. A timing device comprising:

time display means having a dial with a measurement indicator from a zero time position to a maximum measurable time position, and pointers capable of rotating above the dial in a fan-shaped trajectory;

pointer drive means for driving the pointers above the dial from the zero time position to the maximum measurable time position; and pointer stopping means for stopping the pointers after the maximum measurable time has passed;

wherein the drive means stops the pointers at a position past the maximum measurable time position after the maximum measurable time has passed;

wherein the dial further has an extra display section for indicating that the maximum measurable time has exceeded; and the drive means stops the pointers above the extra disolav section after the maximum measurable time has passed.

11. The timing device according to claim 10, further having pointer resetting means for returning the pointers stopped by the pointer stopping means to the zero time position.

12. The timing device according to claim 10, further comprising drive initiating means for initiating the driving of the pointer drive means upon receiving a measurement command while the pointers are in the zero time position.

13. A timing method comprising:

preparing a timing device having a dial with a measurement indicator from a zero time position to a maximum measurable time position, and pointers capable of rotating above the dial in a fan-shaped trajectory;

driving the pointers above the dial from the zero time position to the maximum measurable time position; and stopping the pointers after the maximum measurable time has passed.

* * * * *